US006210549B1

(12) United States Patent
Tharp

(10) Patent No.: US 6,210,549 B1
(45) Date of Patent: Apr. 3, 2001

(54) FLUORINE GAS GENERATION SYSTEM

(76) Inventor: Larry A. Tharp, P.O. Box 10609, Lynchburg, VA (US) 24506

( * ) Notice: Subject to any disclaimer, the term of this patent is extended or adjusted under 35 U.S.C. 154(b) by 0 days.

(21) Appl. No.: 09/191,194

(22) Filed: Nov. 13, 1998

(51) Int. Cl.[7] ..... C25C 3/00

(52) U.S. Cl. ..... 204/247; 204/244; 204/286.1; 204/288

(58) Field of Search ..... 205/619; 204/194–285, 204/278, 288, 244, 286.1, 247

(56) References Cited

U.S. PATENT DOCUMENTS

| | | | | |
|---|---|---|---|---|
| 3,069,345 | | 12/1962 | Lowdermilk et al. . | |
| 3,437,539 | | 4/1969 | Smith . | |
| 3,708,416 | | 1/1973 | Ruehlen et al. . | |
| 3,752,465 | | 8/1973 | Siegmund . | |
| 3,773,644 | * | 11/1973 | Tricoli | 204/252 |
| 4,046,664 | | 9/1977 | Fleet et al. . | |
| 4,139,447 | | 2/1979 | Faron et al. . | |
| 4,176,018 | * | 11/1979 | Faron | 204/60 |
| 4,203,819 | | 5/1980 | Cope . | |
| 4,357,226 | | 11/1982 | Alder . | |
| 4,511,440 | * | 4/1985 | Saprohkin | 204/60 |
| 4,602,985 | | 7/1986 | Hough et al. . | |
| 4,950,370 | | 8/1990 | Tarancon . | |
| 5,085,752 | | 2/1992 | Iwanaga et al. . | |
| 5,290,413 | | 3/1994 | Baur et al. . | |
| 5,366,606 | | 11/1994 | Tarancon . | |
| 5,373,324 | | 1/1995 | Hodgson . | |
| 5,688,384 | * | 11/1997 | Hodgson | 204/229 |

FOREIGN PATENT DOCUMENTS

| | | |
|---|---|---|
| 0565330B1 | 7/1997 | (EP) . |
| 0852267A2 | 7/1998 | (EP) . |
| WO 96/08589 | 3/1996 | (WO) . |

OTHER PUBLICATIONS

Harrington, Charles d. and Ruehle, Archie E., *Uranium Production Technology*, D. Van Nordstrand Company, Inc., 1959 No month available.

Rudge, A.J., *The Manufacture and use of Fluorine and Its Compounds*, Oxford University Press (1962) No month available

* cited by examiner

*Primary Examiner*—Kathryn Gorgos
*Assistant Examiner*—J. Maisano
(74) *Attorney, Agent, or Firm*—Richard C. Litman

(57) ABSTRACT

A fluorine generating cell apparatus, system, and method for the production of fluorine gas having an electrolyte melt flow circulation, a corrosion resistant anode connection, a separation skirt aiding in the circulation of the electrolyte melt, having a controlled gas recombination fail-safe, and a cathode arrangement enhancing efficiency and anode life by providing enhanced effective surface area for each anode.

16 Claims, 13 Drawing Sheets

FLUORINE GAS GENERATION SYSTEM

BACKGROUND OF THE INVENTION

1. Field of the Invention

The present invention relates to the configuration of various components in electrochemical cells for the generation of fluorine by electrolysis of a fused potassium fluoride—hydrogen fluoride electrolyte. In a further aspect, this invention relates to a process for the operation of an electrochemical fluorine cell.

2. Description of the Related Art

In the electrolytic production of fluorine gas, the reaction vessel in which the reaction occurs is commonly referred to as a "cell". The major components of a cell usually comprise the following six elements. First, an electrolyte resistant container (case) normally jacketed with a temperature control system. Second, an electrolyte, operated in the fluid state (melt), typically comprising about 39 to 42% hydrogen fluoride, although concentrations outside this range are acceptable.

Third, in some cells, a cathode is made an integral part of the cell case, while fourth, an anode is typically made of ungraphitized carbon. The carbon can have either low-permeability or high-permeability, and may be composed of a monolithic structure or a composite structure. Nickel anodes are also occasionally used. Fifth, a gas separation assembly, which captures a cathode produced gas, $H_2$, in a chamber and an anode produced gas, $F_2$, in a chamber above the melt and separated by a metal wall or skirt. The skirt extends from the top of the cell (cell top) below the normal operating surface of the melt. Some cells also have a sixth (6) component which is a separation diaphragm that extends from the bottom of the skirt below the melt surface to below the end of the anode. The diaphragm is made of a porous media. The diaphragm provides a means for the separation of gas bubbles of hydrogen (formed at the cathode) and the generated fluorine (formed at the anode), to prevent spontaneous and often violent reforming of hydrogen fluoride, as disclosed in U.S. Pat. No. 4,602,985 issued to Hough. The configuration of each of these components and the characteristics of the materials used therefor determines the efficiency and life of each.

In the majority of the commercially operated fluorine cells the anodes are ungraphitized carbon blades, having planar or flat surfaces, are approximately 8 inches wide by 2 inches thick and hang down vertically from 10 to 29 inches in length. These blades are normally bolted to a copper buss bar inside the cell, or are suspended individually through the cell head and fastened to a hanger assembly, as in U.S. Pat. No. 5,688,384 Hodgson. Both these methods and others connect the power supply posts (rods), by penetrating the carbon blade either by bolting the blade to the buss through a drilled horizontal hole in the carbon, or by another method of drilling and tapping a vertical hole into the carbon and the power supply rod is screwed into the hole. These carbon to metal connections are frequently the source of high cell maintenance and short cell life cycles. The large flat face of these anodes are mounted parallel to the flat surface faces of the cathode plates.

The production capacity of a fluorine gas generator cell is commonly understood to be a factor of the quality of the carbon in the anode, and of its ability to withstand a passage of a given electrical current density (as measured in amperes per square inch of interactive surface area) between the parallel interactive surfaces of the anodes and the cathodes. Operating at higher current densities can cause the anodes to degrade and burn away as $CF_4$ gas. Therefore the total interactive surface area for each anode in a cell times the number of anodes in that cell, will determine the maximum amperage that can be applied to the cell safely. Thus, the fluorine production capacity of the cell is determined by the surface area of the anode.

In the majority of the commercially operated fluorine cells the cathode plates are mounted in a fixed position parallel to the two large anodes faces of each anode blade. The cathode is suspended from posts that penetrate the cell head through isolating packing couplings. This configuration is frequently a factor in poor cell performance. The configuration of the cell head chamber separating skirts, their position between the anodes and cathodes and the depth below the varying electrolyte melt level individually and collectively effect production capacity, product quality, and cell life cycle time.

The configuration and location of the anodes, cathode and skirts with respect to each other all effect the circulation of the electrolyte melt in the cell. The most commonly used fluorine cells today do not have a designed melt circulation path providing beneficial melt temperature control, gas bubble separation into proper chambers, and proper mixing of the hydrogen fluoride feed into the melt. All these factors result in poorer than optimal performance.

The anode hanger support is a carbon to metal connection, one of the primary keys to a long fluorine cell cycle life. In order to maximize the cycle life, there are three major problems which must be overcome.

1. The anode-support connection is subject to contamination by melt creeping into the joint.
2. The fluorine cells commonly in use today have a high current density at the carbon to metal interface. This connection is normally placed under the surface of the electrolyte melt to help dissipate the heat, but this results in the melt creeping into the joint thereby degrading the electrical connection, creating hot spots, and shortening the cycle life.
3. In the majority of the commercially operated fluorine cells present day, an individual cell has banks of anodes that operate in parallel to each other on each bank, but in series to anodes on the other bank. The failure of one anode can have a dynamic shift in current density to the other anodes on that bank of anodes, leading to early failure of the anodes forced to carry the extra load. The fluorine cell components are normally located inside the cell case. The cell case is normally a rectangular box shaped container with a top flange so everything nests inside of the case and supported at the case flange.

The case normally rests on support legs or wheels and has electrical isolation pads between each support to prevent current flow to ground. The case is normally used in maintaining a controlled temperature of the melt inside of the case. The cell case walls are normally jacketed with heat exchanger panels, so heating or cooling fluid media may pass through the heat exchange panels, regulating the melt temperature. In some cells, the heat exchange media is passed through tubes inside the cell case to assist in controlling the melt temperature. Heating temperature control occasionally is applied to the bottom of the case with electrical heating elements. In some cases, the cell case itself is used as the cathode for the cell.

An electrical isolation barrier (such as a sheet of plastic material like PTFE) is placed over the bottom of the cell so as to prevent cathodic interaction with the cell floor and the anode blade(s). Such a component prevents electrolytic interaction from the bottom of the cell up to the anode blades. Such an interaction risks producing both hydrogen and fluorine gases proximate one another. Such cathodic interaction would result in gases which could not be separated, potentially resulting in uncontrolled recombination of the gases, both a potentially hazardous condition and at best a waste of energy.

In prior art the cathodes are supplied power by way of posts that pass through the head plate or through the cell case. Prior art only utilizes two parallel anode surfaces for interactive current flow, not fully utilizing the all available anode surface area. However, the prior art does not supply power through a flange plate that is electrically isolated from the head plate and the case as in the instant invention.

Some cell cases are equipped with special sight glass port windows to allow visual observation of the melt levels and any other activity in the hydrogen side gas chamber of the cell, thus permitting persons to monitor the electrolyte level.

U.S. Pat. No. 5,688,384 issued on January 1997 to Hodgson discloses anodes of ungraphitized carbon blades, planar or flat surfaced, bolted to copper buss bar inside cell fastened to a lug assembly, power supply, bolted rods penetrating a drilled/boring hole in carbon or by method of drilling and tapping a vertical hole into carbon & power supply rod screwed in the hole. The holes are a source of maintenance problems. U.S. Pat. No. 5,378,324 issued on January 1995 to Hodgson focuses on macroscopic elements of a fluorine collection system. P.C.T. application WO 96/08589 published March 1996 to British Nuclear Fuels, discloses a system for electrolysis of fluorine focussing on the collection chamber. E.P.O. application EPO 852 267 A2 to British Nuclear Fuels discloses nickel coating of the joint for integrity, a nut and bolt or screw attachment of anode to a hanger.

U.S. Pat. No. 3,069,345 issued on December 1962 to Lowdermilk discloses the use of a membrane boot to seal the joint from the fluorine. Regarding a clamp supported by mechanical compressions, the patent discusses the seal/joint integrity problem of electrical contamination, parallel current source, and a shrinking of the electrode to create the seal.

U.S. Pat. No. 3,437,579 issued on March 1966 to Smith discloses horizontal electrodes. U.S. Pat. No. 3,708,416 issued on January 1973 to Ruebner discloses porous electrodes for greater electrode surface area. U.S. Pat. No. 3,752,465 issued on August 1973 to Siegman discloses a rotatable cam clamping means for moving electrodes into and out of solution, with a nut and bolt securing means. U.S. Pat. No. 4,046,664 issued on September 1977 to Fleet discloses a fibrous electrode to increase the electrode surface area. U.S. Pat. No. 3,773,644 issued on November 1973 to Tricoli discloses using a gas proof coating to maintain anode joint integrity. U.S. Pat. No. 4,139,447 issued on March 1976 to Faron discloses parallel electrodes. U.S. Pat. No. 4,176,018 issued on November 1979 to Faran discloses using electrodes in parallel. U.S. Pat. No. 4,203,819 issued on May 1980 to Cope discloses a flow detection means.

U.S. Pat. No. 4,357,226 issued on November 1982 to Alder discloses anodes with abutting aluminum connections perpendicular to the anode, and a joint above solution. U.S. Pat. No. 4,511,440 issued on April 1985 to Sparakhisn discloses expanded surface area through holes in electrode.

U.S. Pat. No. 4,950,370 issued on August 1990 to Tarancan discloses parallel anodes, a pump and flow mechanism increasing efficiency of the electrolysis through active circulation of the electrolyte, and the use of horizontal electrodes sandwiching a two side electrode between a cathode, the connection and sealing internal to brushes in the vessel. U.S. Pat. No. 5,085,752 issued on February 1992 to Iwanga discloses a methodology for collecting fluorine gas. U.S. Pat. No. 5,290,413 issued on March 1994 to Bauer discloses overcoming connection failure by coating the connection, and purging fluorine from joint, and the use of parallel electrodes. U.S. Pat. No. 5,366,606 issued on November 1994 to Taracon discloses gas collection chambers.

The published book by Rudge, A. J., "The Manufacture and Use of Fluorine and Its Compounds," pp. 18–45, 82–83, Oxford University Press (1962) which is incorporated herein by reference, discloses the use of porous anodes for enhanced surface area, and the use of MONEL™ skirts in the separation of the hydrogen and fluorine gas into their respective chambers, and the use of a cooling jacket to heat and cool the electrolyte melt to operating temperature, but does not teach the creation of an electrolyte melt flow circulation.

The published book by D. Van Nostrand Company, Uranium Production Technology, pp. 469–473, Colonial Press (1959), discloses the basic construction and use of fluorine generation cells.

None of the above inventions and patents, taken either singularly or in combination, is seen to describe the instant invention as claimed. Thus a fluorine gas generation system solving the aforementioned problems is desired.

SUMMARY OF THE INVENTION

This invention is applicable to a range of fluorine generating cells from 200-amp hours power loading up to more than 16,000 amp hours per cell. This covers cells with only one anode, up to more than 48 anodes/cell.

According to one aspect of the present invention, the anode support hanger provides a specific means for making the carbon to metal connection. It is unique in that there are no bolt or rod penetrations of the anode blade to support it or to provide the current carrying connection. The anode support hanger is also unique as an assembly unit. The anode hanger is one where each anode can be extracted and replaced into the cell through the cell head plate. Each anode has two all-thread current supplying posts. The top of the carbon anode is polished flat to near a mirror finish. A ¼ to ½ inch thick metal plate, that has been polished and is the same horizontal dimension as the top of the blade is laid flat on the blade. With a commonly used anode blade, optimally 2 inches by 8 inches, this will provide 16 square inches of metal-carbon contact surface. Of course, this area will vary with anodes of a different thickness or width. Each blade is grooved with one horizontal groove on each width face and a preformed metal channel with tongue pressure-pressed onto the blade grooves. The all-thread current posts are threaded into the channel piece, and torque loaded to apply a uniform pressure loading on the top carbon contact plate. The metal to carbon connection assembly is positioned in the cell so that under normal operation, the electrolyte melt level will be below it and not contact the metal of the assembly, except under abnormal pressure differential swings.

According to another aspect of the present invention, the configuration of the cathodes (grate type grid) and the arrangement of the anodes with the chamber skirting arrangement relative to each other form a thermally and kinetically induced circulation of the electrolyte melt. The newly formed low density bubbles of each gas along with the exothermic heating of the melt (lowering the melt density near the anode-cathode surfaces), will force the melt to rise between the interactive surface of the anode plates and the cathode plates respectively. Due to the skirting arrangement, the melt at the top of the anode chamber will be moved to one cell case wall, where it is cooled (increasing the melt's density), and it falls to the bottom of the cell under the plates (cathode plate grid). The melt at the top of the cathode chamber is diverted to the opposite wall of the cell case where it is cooled, and falls to the bottom of the case along the wall and then under the plates to complete the circulation loop. The cooling media in the cell case cooling jackets is to be at its coolest along the top of the cell melt level, to give the most rapid cooling effect and heat removal from the electrolyte melt, and to promote more rapid down flow of the melt along the cell wall. The cooling media, which may be controlled via valve systems, enters at the top of the jacket so as to cool the surface electrolyte creating a natural downward path of the electrolyte. The warmed cooling media in the cell case jacket would be expected to exit at the bottom of the case jacket (the liquid cooling media temperature at the exit point should never be colder than the electrolyte melt point temperature, but within 15 degrees F. of that temperature). This uninhibited melt circulation flow pattern will promote the following:

(a) the overall melt in the cell will remain cooler, with less heat accumulation at the melt surface, reducing the boil off of hydrogen fluoride and gas-borne electrolyte misting;

(b) the upward flow movement of the solution in between the anode and cathode surfaces will assist in preventing the bubbles clinging to the plate surfaces. This will assist in moving the bubbles upward along their respective plate surface past the separating skirt to the melt surface in that gases' respective gas chamber, reducing the potential for bubble interaction and sub surface gas recombination;

(c) the reduction of stagnant pockets of electrolyte melt in the cell;

(d) a more uniform blending of the hydrogen fluoride feed to a more uniform concentration throughout the melt in the cell; and (e) a uniform electrolyte current resistivity for all anode—cathode interactive surfaces.

According to another aspect of the present invention, the configuration of the cathodes (grate type grid) and the arrangement of the anodes with the chamber skirting arrangement relative to each other form a thermally and kinetically induced circulation of the electrolyte melt.

According to another aspect of the present invention, a 3-inch diameter viewing port is positioned at one end of the fluorine cell case, on the side of the larger $H_2$ chamber. It is positioned where the normal melt level is in the middle of the glass, permitting the full internal length of the cell to be viewed for possible fluorine gas cross over and recombination with the hydrogen gas. The melt circulation can also be monitored.

According to another aspect of the present invention, the anodes are arranged in columns. All the anodes in a given cell are wired in parallel uniform electrical current loading to each anode. The surface area and the quantity are selected in proportion to the production rate requirements for the operation.

According to another aspect of the present invention, the configuration of the cathode forms a box around each anode blade, with all four (4) flat sides having a corresponding interactive parallel cathode plate to it, maximizing the fluorine generating capacity per anode. The cathode plates (plate grid) are suspended from a flange positioned between the cell case flange and the cell head flange and electrically isolated from each. The cathode flange has an electrical connection lug for power to the cell. The cathode flange has threaded bolt holes so the cell head and cathode can be lifted from the case as a unit for maintenance, or assembled together before placing them in the cell case. With the cathode grid forming a box around each anode, the failure and breaking off of an anode blade is contained and the potential for short circuiting cell failure is reduced.

Another aspect of the present invention is the configuration of the cell head skirt, that separates the $F_2$ and $H_2$ gas chambers, also collects the $H_2$ gas from all four (4) anode interaction surfaces for each anode in a cell. The ostensibly V-shaped notch, which is approximately ⅛ inch high, is made in the skirt lip below the normal electrolyte melt level, between the gas skirted chambers, and positioned so that in the presence of high gas pressure differentials, gas recombination from either chamber can occur, without melt being hydraulically forced out the top $F_2$ or $H_2$ gas discharge lines. Hydrogen or fluorine will bleed through from its respective chamber, whichever has the higher pressure, into the lower chamber of the other electrolyzed gas. Such recombination occurs spontaneously resulted in a limited controlled explosion, thereby increasing pressure on the previously low pressure side toward equalization with the higher pressure side. This also has the desirable feature of equalizing electrolyte level between the two chambers with the equalization of the vapor pressure. In no location is the skirt physically positioned between the anode and cathode, where either could place an electrical charge on it, causing it to have a role in the gas generating process (creating gas recombination problems inside a cell). In some cells where the anodes are required to be uncommonly long, and gas separation assistance is needed, permeable membrane diaphragms (<9 mesh hole size screen) may be used as an extension to the skirt. The diaphragm would extend down between the anode—cathode plates, but would be electrically isolated from the skirt to minimize its potential to electrically charge the skirt or vice versa, where they could improperly participated in the activity of gas generation. This is an activity commonly used in commercial fluorine cells today. Some of the advantages of the invention, include:

(a) the anode hanger support assembly properly installed allows the metal to carbon contact point to be operated above the melt level without degradation of the carbon blade;

(b) giving the carbon blade longer life;

(c) potential to operate each blade with a higher current density through this contact interface point;

(d) potential to operate with longer anodes and more total interactive surface 95 area per blade;

(e) reduce the potential for anode support dissolution into and contamination of the electrolyte melt;

(f) the assemblies are reusable on other carbon anode blades, and are easily changed;

(g) each anode can be changed out independently of any other anode blade changes, and easily aligned for proper distance spacing from the respective cathode interactive surfaces; and (h) alternately, if the maximum current is to be maintained for the blade with respect to prior art loadings, the total ampere current loading could be increased by 25% above the maximum loading normally seen in other commonly used fluorine cells, resulting in an increase in fluorine production capacity of about 25% without further negative effects on the cell or the quality of the fluorine product.

The cell head gases chamber and skirting arrangement nests into and above the cathode grid and flange assembly about a vertical axis. The skirting arrangement encircles the anode about the vertical axis of the anode, the skirting extending below the surface of the melt and to the cell head. The skirting forms a portion of the separation barrier in directing the hydrogen cathodic gas to its respective chamber and the anodic fluorine gas to its respective chamber. The head flange bolts to the cathode flange. When bolted together, the skirting assembly is perfectly aligned with the cathode grid, as also are the anode blades with the cathode grid, since they are alignment mounted in the cell head cover plate. The skirting assembly is normally fabricated using Monel plate, which is welded to the underside of the cell head cover plate. Each anode has two current posts that are mounted through an electrically isolating packing seal junction port in its anode cover plate, which is individually mounted and electrically isolated from the cell head cover plate. These two isolation seals also isolate the fluorine gas chamber from the outside atmosphere.

Accordingly, it is a principal object of the invention to provide a system and apparatus providing a passive melt flow circulation past anodes and cathodes aided by a skirting arrangement and a water jacket, said circulation cooling electrodes, electrolyte melt, mixing existing electrolyte with old electrolyte.

According to one object of the present invention, the anode support hanger, provides a specific means for making the carbon to metal connection without using bolts or rod penetrations of the anode blade for connection and support or provide current carrying connection.

It is another object of the invention to provide an anode mounting means for reducing electrolyte contamination of the anode to metal contact, thereby reducing hot spots, and degradation of the anode.

It is another object of the invention to provide a cathode grid arrangement for the efficient utilization of the interacting anode surfaces thereby reducing current density and extending anode life.

It is still another object of the invention to provide an electrolysis gas separation means which will result in a minimizing of Hydrogen and Fluorine gas intermixing.

It is still another object of the invention to provide an electrolysis gas separation means which will provide a controlled chamber pressure and electrolyte level within the isolation cavities such that equalization may be done in a way which minimizes damage to the cell.

It is still another object of the invention to provide a means for recombining hydrogen and fluorine gas in a controlled safe manner.

It is an object of the invention to provide an improved fluorine generation system producing more fluorine for a given current.

It is an object of the invention to provide a fluorine generation system capable of integrating circulating melt flow with a gas separation skirting such that each mutually enhances the other function.

According to another object of the present invention, the configuration of the cathodes (grate type grid) and the arrangement of the anodes with the chamber skirting arrangement relative to each other, form a thermally and kinetically induced circulation of the electrolyte melt.

It is an object of the invention to provide improved elements and arrangements thereof for the purposes described which are inexpensive, dependable, fully effective in accomplishing its intended purposes, and suited for ease of maintenance through the use of interchangeably modular components.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention, as shown in FIGS. 1–10, details the arrangement of the elements in a complete system, resulting in a thermal-kinetic electrolyte melt circulation path being provided in the cell. This action assists in the evolution of gases of hydrogen and fluorine being discharged to the specific gas chambers (fluorine gas chamber 15 and hydrogen gas chamber 16) above the melt.

Figure 1:
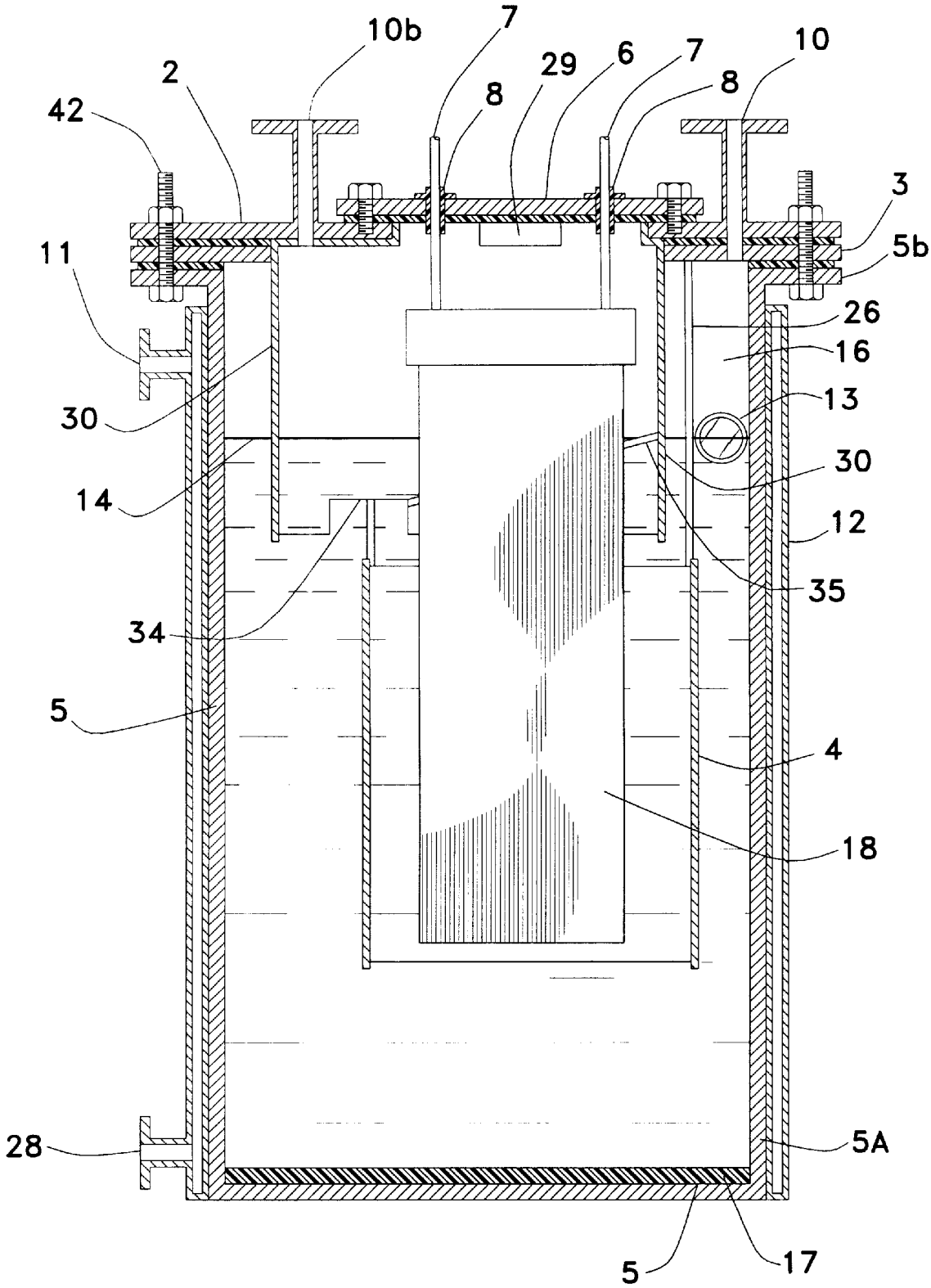
FIG. 1 shows a diagrammatic front section view of a single anode column cell, and how the internal components relate.
Figure 2:
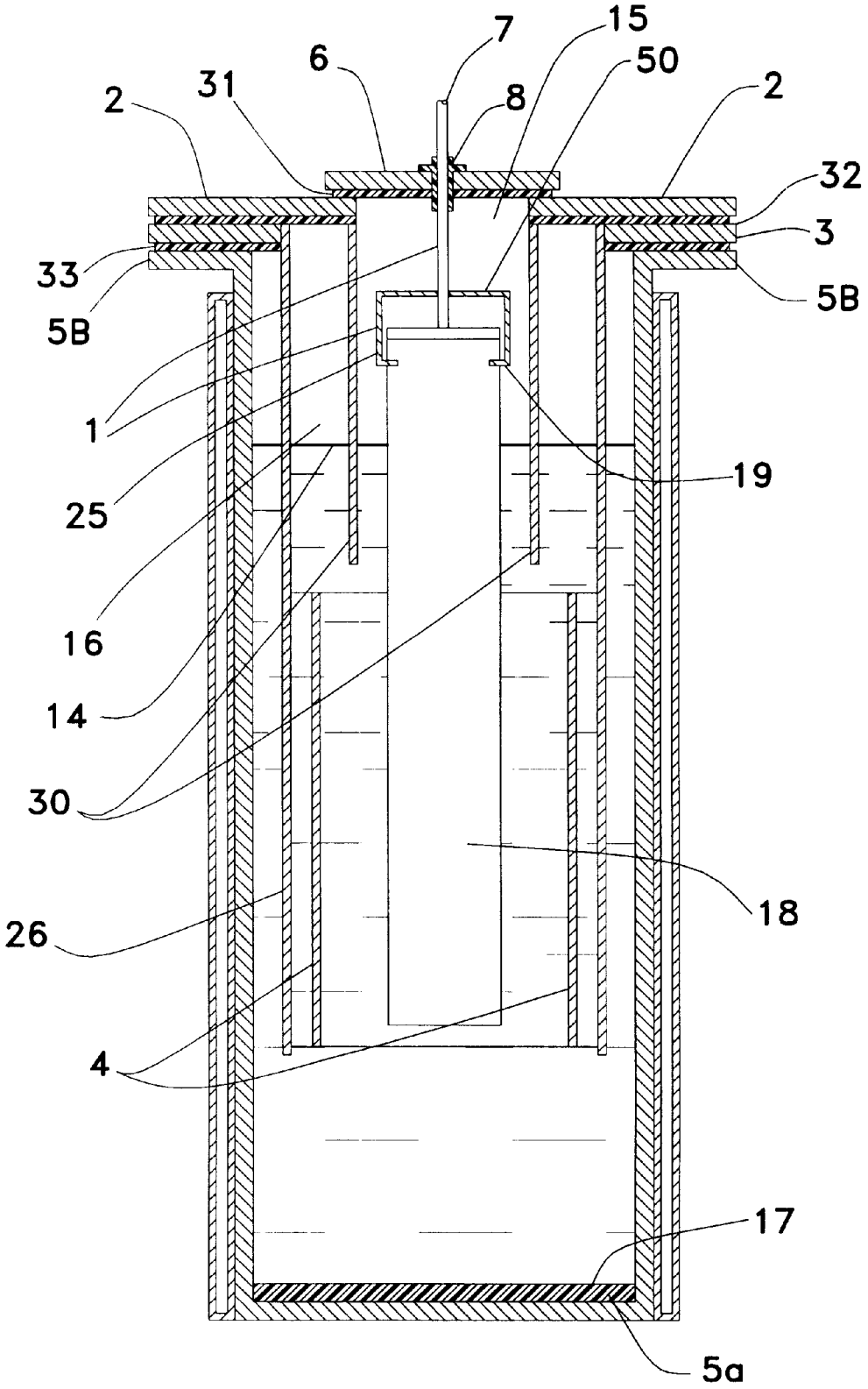
FIG. 2 shows a diagrammatic end sectional view of a single anode cell.

A cell with a single column of anodes is shown FIGS. 1 and 2. The "drop-in anode assembly" 1, made of sub-elements, namely, a mounting plate 6, anode post threaded rods (7,7) and an anode 18, hang suspended in the cell from a head plate 2. The assembly 1 is fixed to maintain a parallel alignment with a gas separation skirting arrangement 30, also referred to as a skirt or a skirt arrangement, and a cathode means 4 around each anode 18. Preferably, the cathode means 4 is a cathode box or cathode grid. The skirt arrangement 30 has hydrogen channels 35, which capture and direct hydrogen bubbles upwardly and outwardly to a cell wall 5, assists in providing a circulation flow path for the electrolyte melt, while providing a more defined gas separation from the point that it is generated (the anode 18 and the cathode means 4) to its specific gas chambers (fluorine gas chamber 15 and hydrogen gas chamber 16).

The skirt 30, as part of the underside of the cell head plate 2, has a fixed position with respect to the anodes 18 and the skirt is nested with respect to the cathode assembly (collectively comprising a cathode support plate 26, and the cathode means 4). The skirt 30 is nested internally with respect to the cathode and about the vertical axis and nests the anode internally about the same vertical axis. The cathode box 4 is suspended inside the cell case 5*a* from the cathode support flange 3 and is electrically isolated from the cell case 5*a*. The lug point 29, also referred to as the power connection lug, is where the cathode power supply 48 connection interfaces the anode post thread rods (7,7) and serves as the connection for the parallel anode power connections.

The skirt 30, with hydrogen channels 35 and 36, creates two enhanced electrolyte melt circulation paths. One is aided with the fluorine gas and the other is aided with the hydrogen gas. This enhanced melt circulation works to provide uniform blending of the melt with added fresh hydrogen fluoride feed. The complete body of melt in the cell is rapidly blended to a uniform concentration throughout the solution. This circulation movement helps eliminate melt hot spots and promote a more uniform melt temperature with less differential within the cell. The fluorine—melt path occurs as fluorine is evolved from the anode 18 surface, breaking away into the melt, and moving to the melt surface 14. As the gas moves up, it gives off heat to the adjoining melt. The gas rising movement and the hot melt creates a fluid movement up and into the fluorine chamber 15 proximate the anodes 18. The hot surface melt is displaced by further hot rising melt and moves to the open area in the fluorine gas chamber free of anodes. The melt is directed against the cell case wall 5 where it is cooled due to a case cell wall cooling jacket 38, also referred to as a cooling jacket. As the melt cools and become more dense, it moves down the case wall 5, where it flows under the cathode box 4 completing the circulation loop for the melt flow 27.

The cooling media in the cooling jackets 38 are to be at its coolest along the top of the cell melt level, to give the most rapid cooling effect and heat removal from the hot electrolyte melt, and to promote more rapid down flow of the melt along the cell case wall 5. The cooling media enters at the inlet 11 located at the top of the case jacket 38, so as to cool the surface electrolyte creating a natural downward path of the electrolyte. The warmed cooling media in the cell case jacket would be expected to exit at an outlet 28 located at the bottom of the case jacket 38. The liquid cooling media temperature at the exit point should never be colder than the electrolyte melt freezing point temperature, but within 15 degrees F. of that temperature. This uninhibited melt circulation flow pattern will promote the following:

(a) the average temperature of the melt in the cell will remain cooler, with less heat accumulation at the melt surface, reducing the boil off of hydrogen fluoride and gas borne electrolyte misting;

(b) the upward flow movement of the solution between the anode 4 and cathode surfaces will assist in preventing the bubbles from clinging to the plate surfaces. This assists in moving the bubbles upward along their respective plate surface past the separating skirt to the melt surface into the respective gas chambers (hydrogen or fluorine) reducing the potential for bubble interaction, and sub surface gas recombination;

(c) the reduction of stagnate pockets of electrolyte melt in the cell;

(d) a more uniform blending of the hydrogen fluoride feed to a more uniform concentration through out the melt in the cell than would otherwise be achieved;

(e) and a uniform electrolyte current resistivity for all anode—cathode interactive surfaces.

On the up flow between the cathode 4 and anode 18 surfaces, the melt is split as it contacts the dividing skirt 30 and its hydrogen channels 35 and lips 36 and about 50% of the melt moves on the hydrogen—melt circulation path. The hydrogen—melt path forms as the hydrogen evolves from the cathode box 4 breaking away into the melt and moving to the melt surface 14. The hydrogen gas moves up, giving off heat to the adjoining melt. The rising gas movement and the hot-low density melt create a fluid movement up and into the hydrogen gas chamber 16. The fluid movement is directed by the skirt and its hydrogen channels 35 and lips 36 against the cooling surface of the cell case wall 5, where it is cooled and moves down the wall to under the cathode box 4 completing the circulation loop for the melt flow 27.

Figure 3:
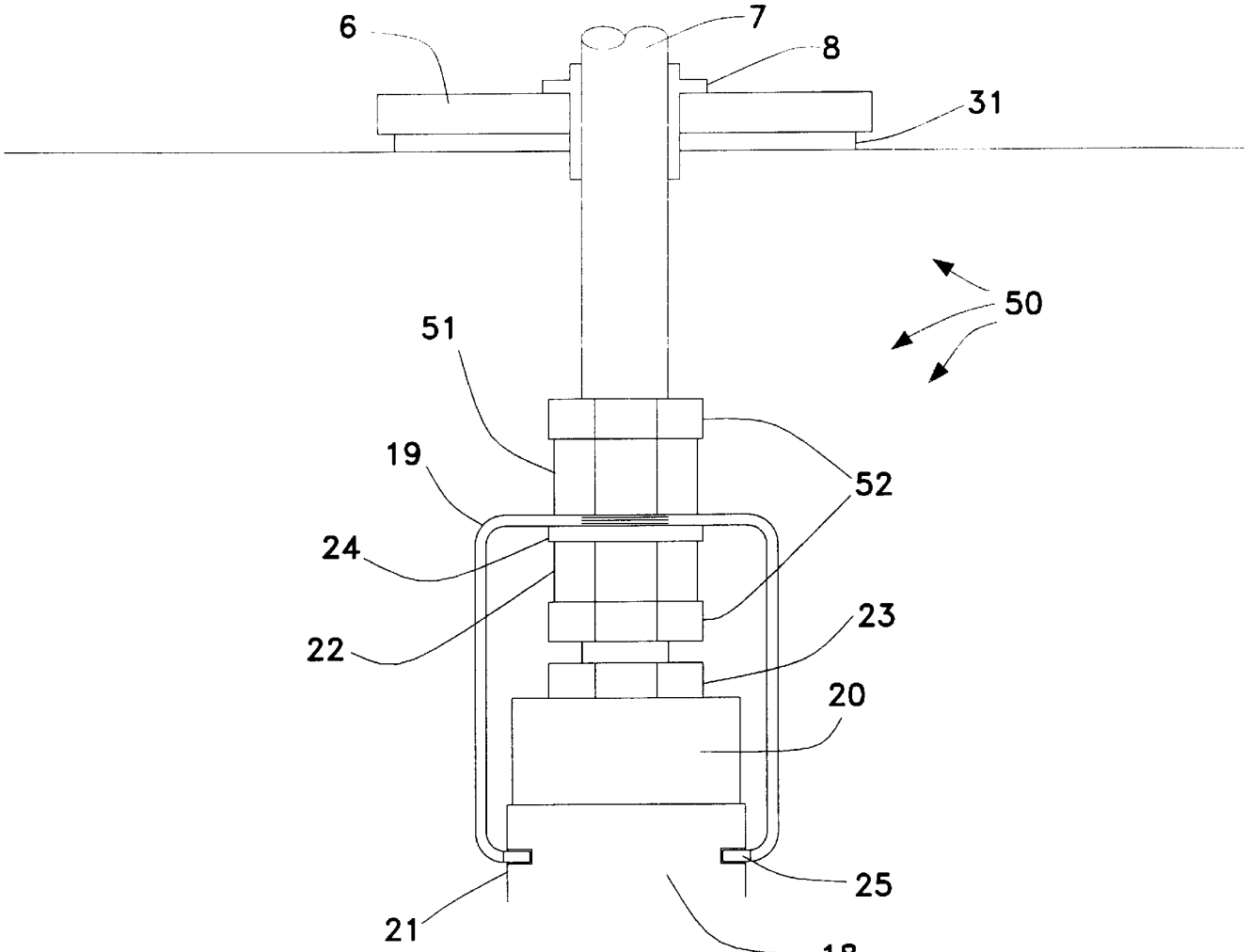
FIG. 3 shows a diagrammatic sectional view of the component arrangement for a single anode support hanger.

The anode support hanger assembly end view, as shown in FIG. 3, features the attachment of an anode hanger 50 to the anode 18, wherein said anode 18 is preferably composed of a carbon blade. The attachment requires that the carbon blade anode 18 have a shallow grooved channel 21, cut horizontally on two opposite wide flat sides or surfaces and approximately one inch below the top end of the blade. The attachment is suitable for use with a variety of anode blade sides or surfaces. The width of the groove will vary based upon the width of metal channel pieces 25, and a metal channel support piece 19.

The top end of the carbon anode will have a flat, near mirror finish, to maximize the metal (metal channel pieces 25) to carbon (anode 18) contact to a metal pressure plate 20. A metal channel support piece 19 is designed with three sides of metal with a metal channel piece 25 turned in from opposing sides. The spacing between the metal channel pieces 25 may vary in distance from a few thousandths of an inch less than the material distance between the grooves in the carbon anode blades to as much as ½ inch less than the material, resulting in grooves as deep as ¼ inch. It should be noted that grooves exceeding ¼ inch go beyond the necessary depth to hold the anode 18 in place and in removing more material from the grooved channel 21 there is a weakening of the anode 18. Grooved channels 18 as little as a few thousandths of an inch provide sufficient depth to hold the anode 18 to the anode hanger 50. The metal channel support piece 19 is to be pressure pressed onto the anode 18, and the its metal channel piece 25 spacing must provide a pressure loading even when the anode and channel are heated to excessive operating temperatures. This must take into consideration the differentials in various metals heat of expansion.

The contact surfaces of the metal channel pieces 25 are polished to a near mirror finish. The metal channel pieces have rounded ends at the end of the channel to provide an open throat to ease the press on fitting to the anode. The support channel piece 19 is approximately the same length as the anode blade top and has two holes drilled in the topside. The holes are spaced to allow the power-supplying all-thread rods (7,7) to slip through the support channel piece 19 and allow torque loading to be uniformly applied to a pressure plate 20. The type of metal used may vary.

The metal contact pressure plate 20 should preferably have a width close to or the same as the carbon blade. The side of the metal contact pressure plate 20 in contact with the carbon anode is preferably finished to a near mirror finish. The thickness of the pressure plate is significant in its need to be sufficient to mechanically carry the load, and will vary dependent upon the strength of the metal. The pressure plate 20 must not permit any deflection, while providing uniform loading contact. The loading pressure is applied to the pressure plate 20 by way of the two current loading anode connecting all-thread rods (7,7) the all-thread rod may be made of iron, brass, bronze, MONEL™ (a NiCu alloy well known in the industry), or other suitable metal.

It should be noted that a cell that has all anodes operating in a parallel current circuit will have a lesser dynamic shift than anodes arranged in series in the event of one anode failure, and the current load increase will be spread evenly to the remaining anodes.

The two all-thread rods (7,7) supply the D.C. power to the anode 18, while supporting the anode 18 and maintaining the contact loading pressure to the anode. Pressure is applied by adjusting pressure loading nuts 22 on the threaded rod 7.

The bottom pressure nut 23, at the end of each all-thread rods (7,7) adjacent to the contact pressure plate 20, is used to help maintain the rod vertical alignment and provides a maximal current flow contact surface area to the pressure plate.

The Bevel washer 24 is placed on the rod between the support channel piece 19 and the pressure loading nut 23. Due to the varying thermal expansion in the metals of the support assembly, uniform loading must be maintained over the expected temperature range. The pressure loading nut 22 inside the metal channel support piece 19 is torque-loaded to apply the necessary loading to the contact pressure plate 20. The back-up nut 22*b* is a locking nut. The nut 51 on top of the support channel piece 19 is used to tighten down on the channel thereby maintaining rod alignment and controlling vibration. This nut 51 is backed up with a lock nut 52. The anode's mounting plate 6 is secured to the cell head plate 2. The anode's mounting plate 6 has a gasket 31 seating between it and the cell head plate, thereby sealing and isolating the anode mounting plate from the cell head plate. The anode mounting plate is secured with electrically isolating components to prevent current flow between the two plates.

The two anode all-thread rods 7 penetrate the cell mounting plate, through holes drilled in the anode mounting plate 6 and aligned for mounting the anode 18. The all-thread rods 7 are secured to the mounting plate 6 to maintain the anode alignment with the cathode box 4. Such hardware is secured using prior art methods such as securing nuts, washers, and electrical isolating components to prevent current flow from the rods to the mounting plate. This mounting connection 8 is also chemically resistant to fluorine gas. The thread rods 7 are pre-positioned and secured to the anode mounting plate 6, so when the anode 18 is pulled for inspection or replaced, a new drop-in anode assembly 1 will hold the anode 18 in the proper position for uniform current density to all four sides of the anode 18.

Figure 4A:
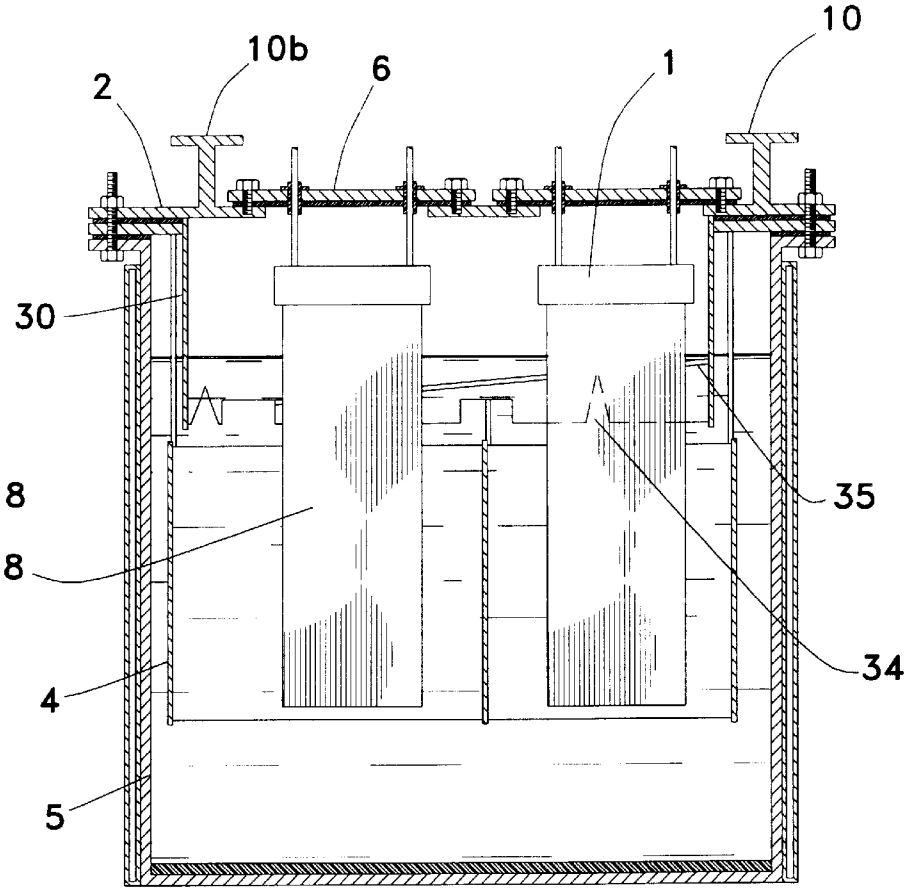
FIG. 4A and FIG. 4B show a diagrammatic side sectional view (4A) and end sectional view (4B) of an alternative two-anode column cell (4 anodes), and how the internal components relate.
Figure 4B:
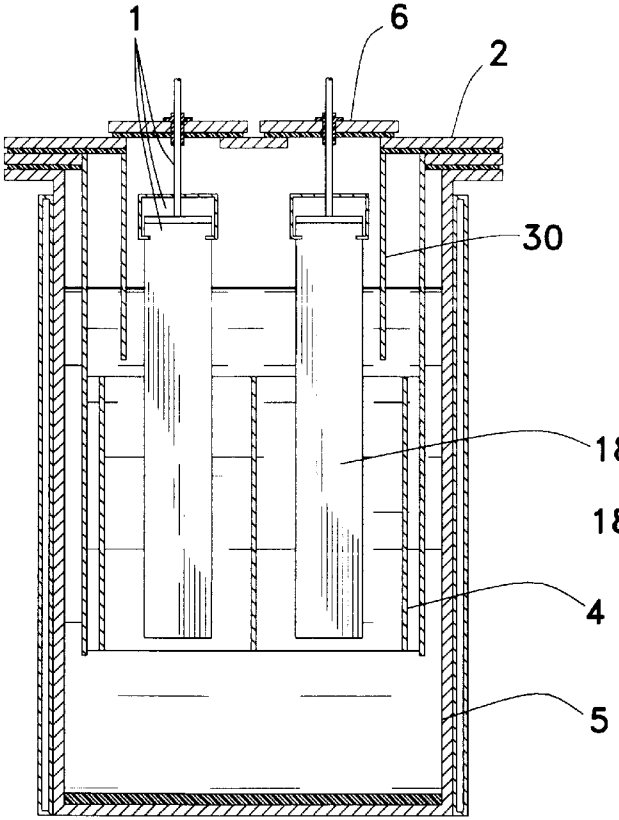

As depicted in FIG. 4, two anodes 18 in a column (side and end views) are shown in a cell. The side view depicts the configuration of a cell with 2 to 20 anodes in a single column cell. FIG. 4B end view illustrates the general internal configuration of a cell with two columns of anodes (each column could contain 2 to 20 anodes). Depicted are the relative positions of the anodes to the skirt 30 and to the cathode.

Figures 5A, 5B, 5C:
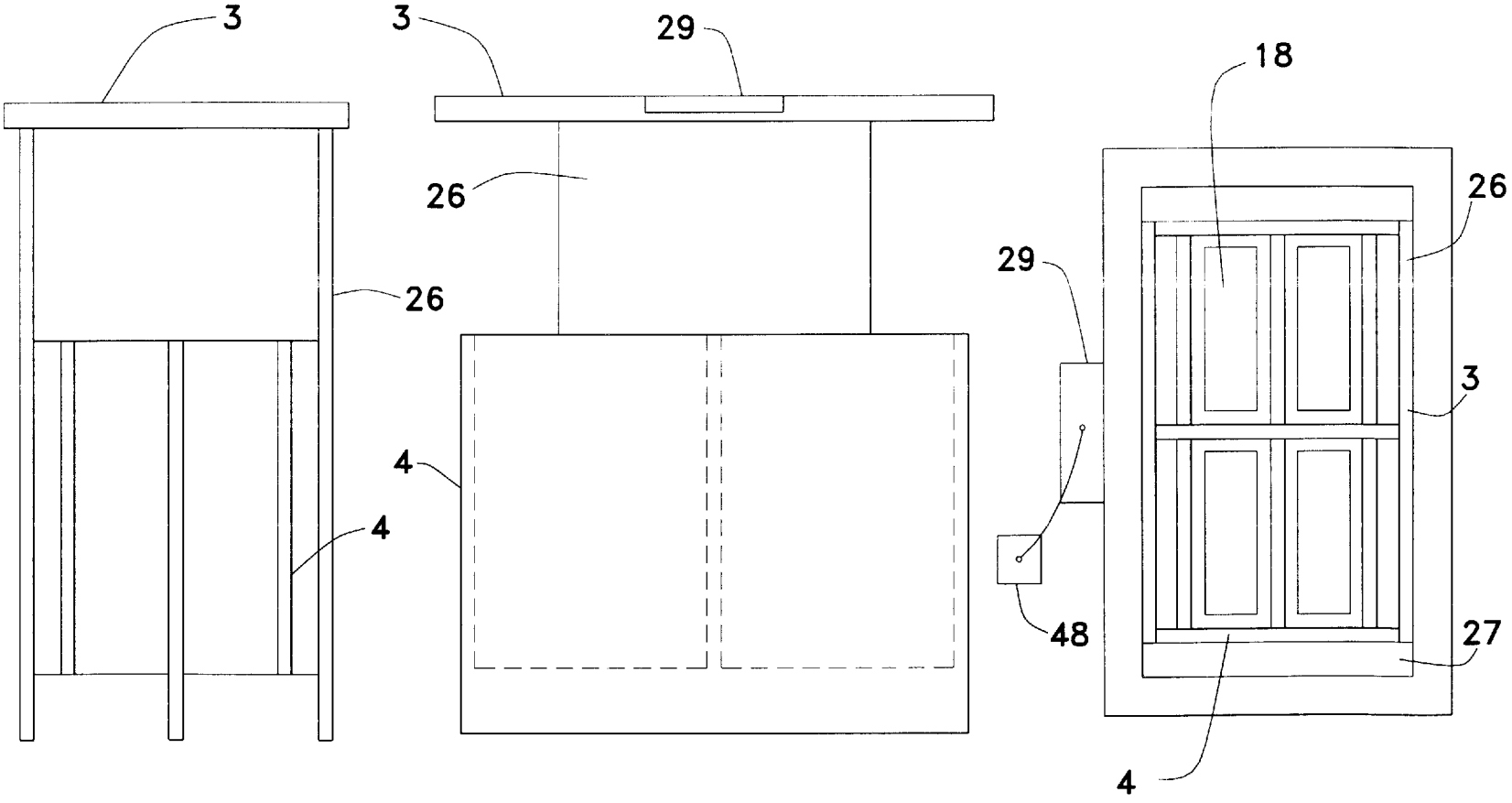
FIGS. 5A, 5B and 5C diagrammatically show the component arrangement for a two anode column "cathode box grid", including side sectional view (5A), end sectional view (5B), and top view (5C).
Figure 6C:
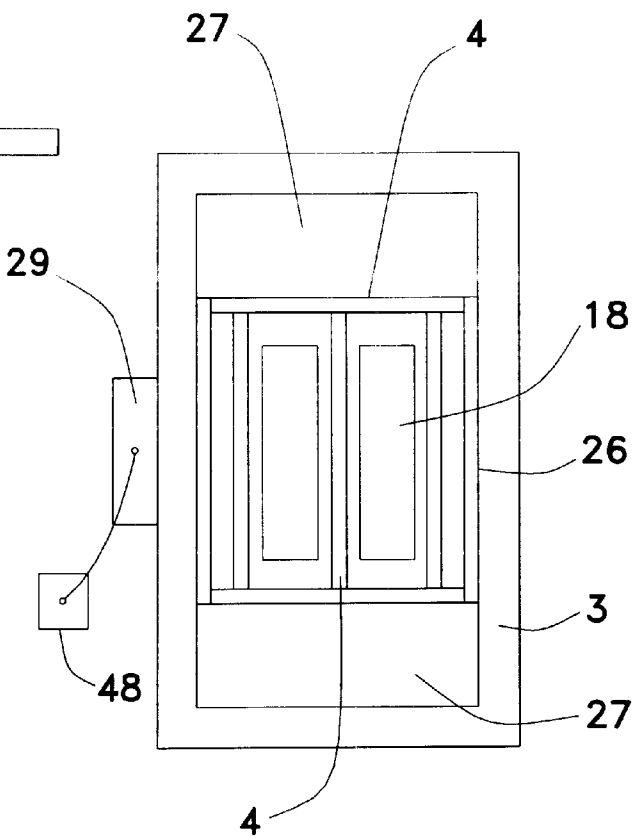
FIGS. 6A, 6B and 6C diagrammatically show the component arrangement for a single anode column "cathode grid", including side sectional view (6A), end sectional view (6B), and top view (6C).
Figure 6B:
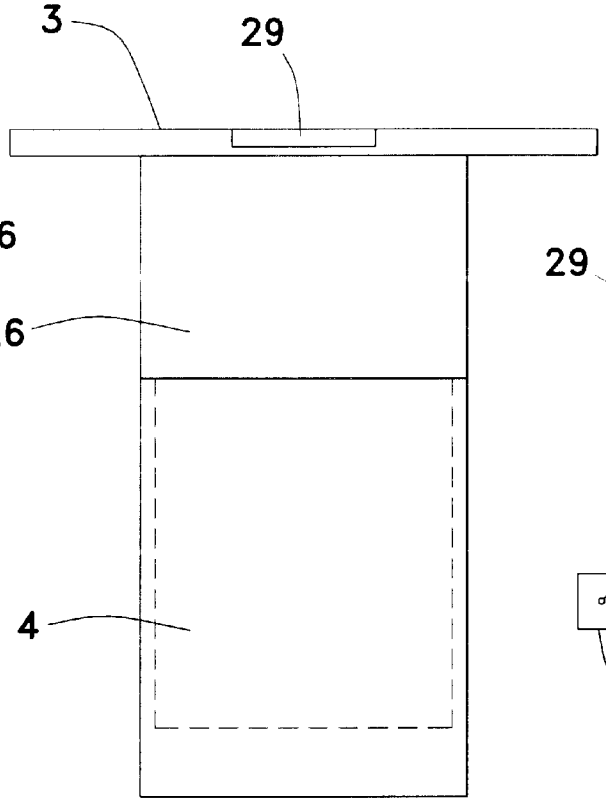
Figure 6A:
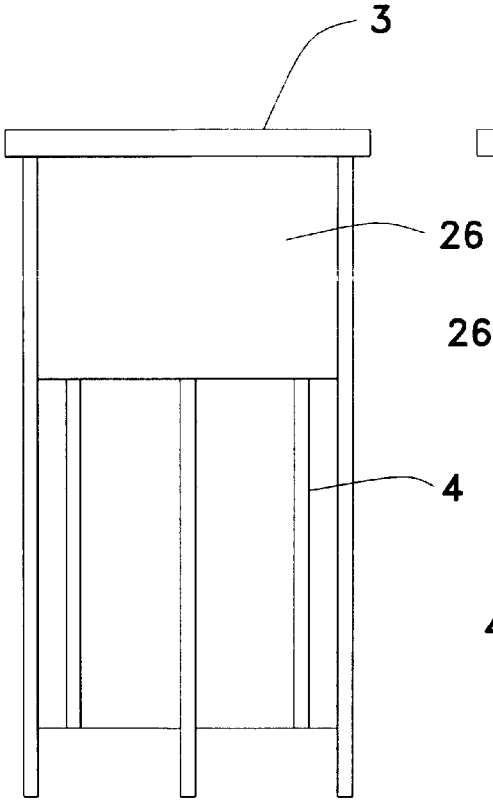
Figure 7A:
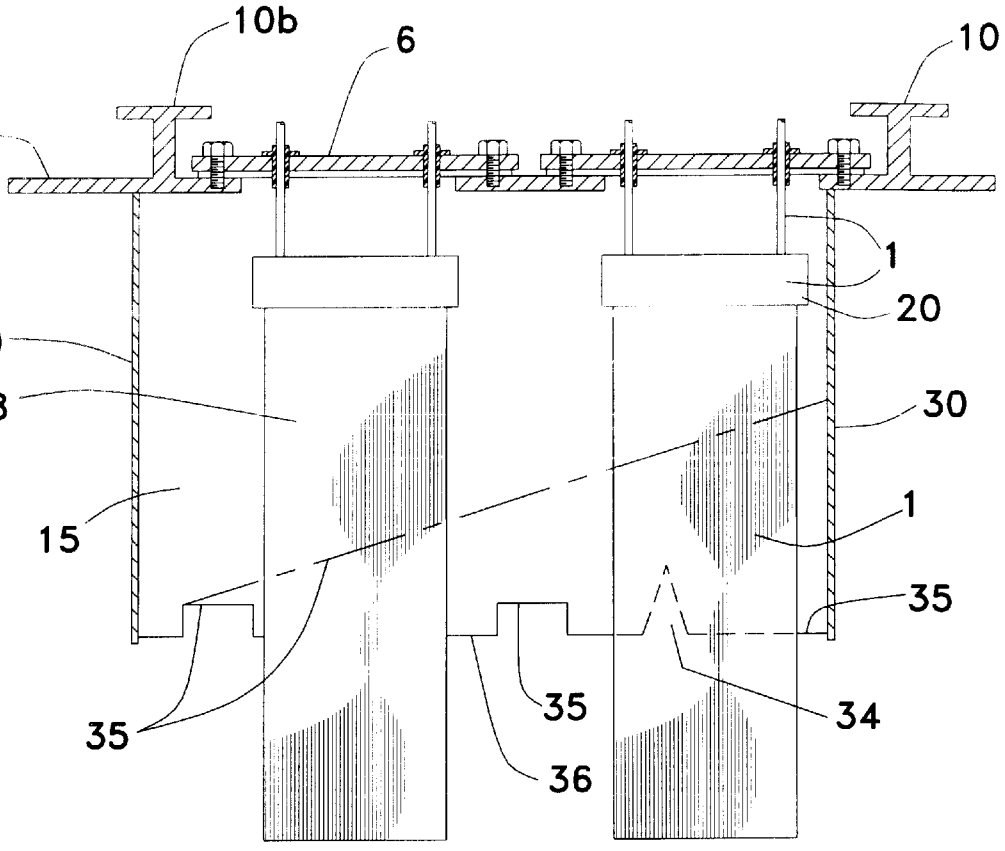
FIGS. 7A through 7D diagrammatically show the fluorine cell head and skirting arrangement with gas chambers for a two-anode column cell, including end sectional view (7A), side sectional view (7B), bottom view (7C) and top view (7D).
Figure 7B:
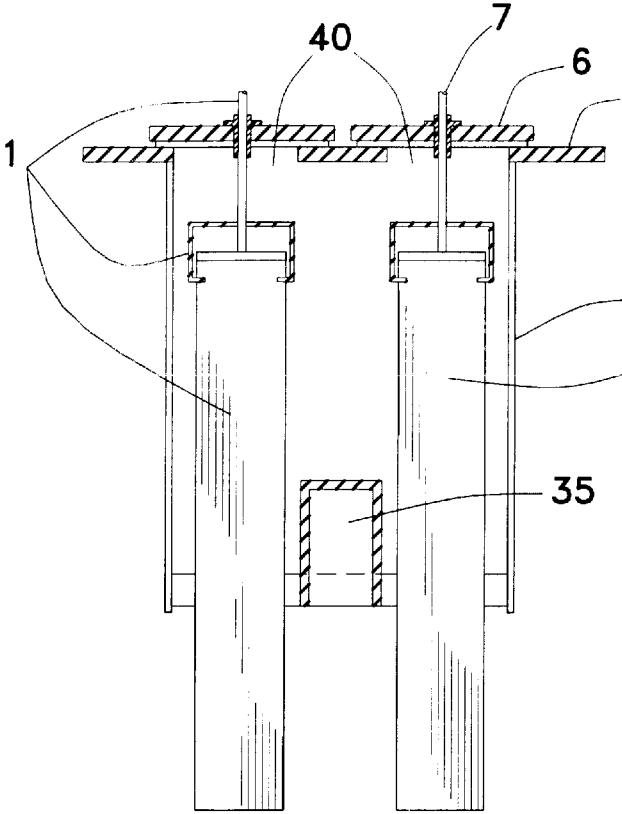
Figure 7C:
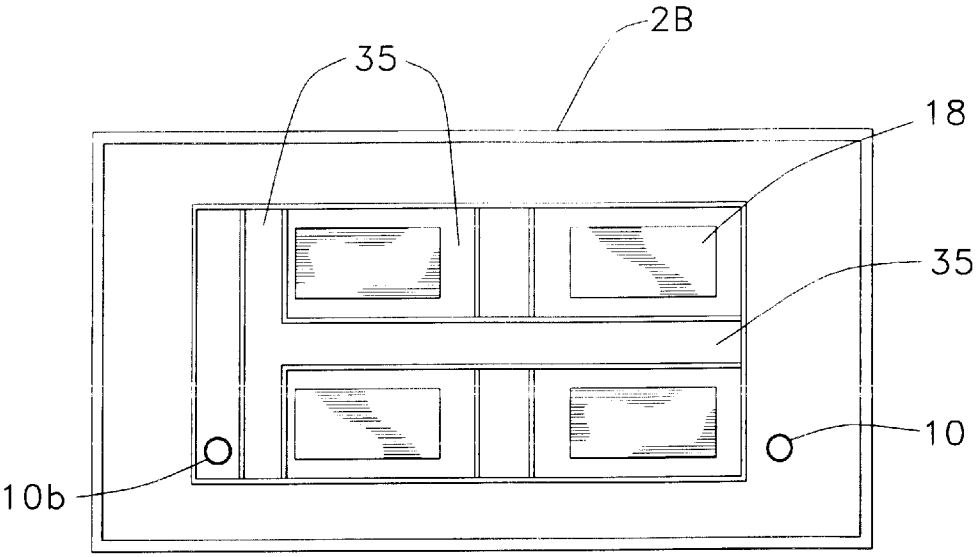
Figure 7D:
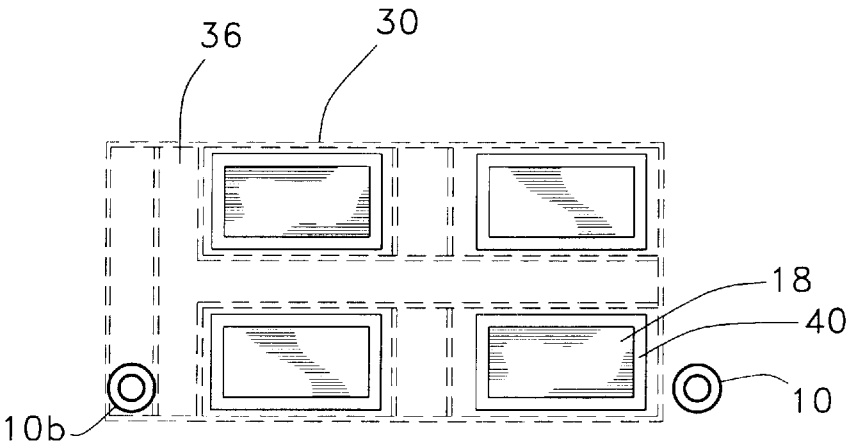
Figure 8A:
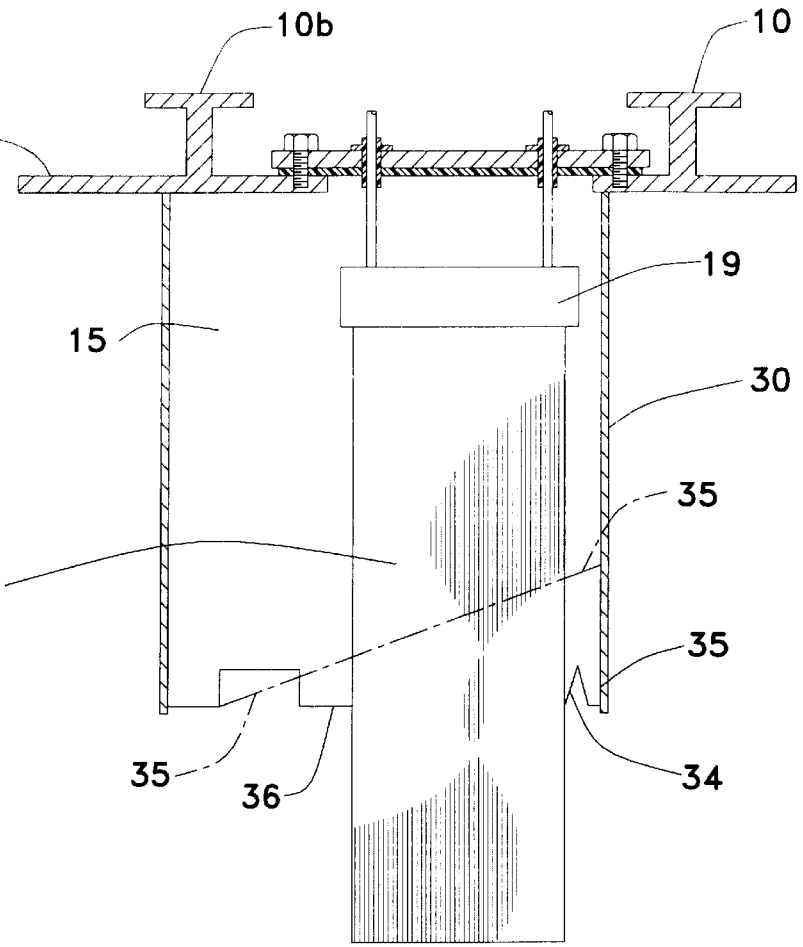
FIGS. 8A through 8D diagrammatically show the component head plate skirting arrangement for a single anode column cell, including end sectional view (8A), side sectional view (8B), bottom view (8C) and top view (8D).
Figure 8B:
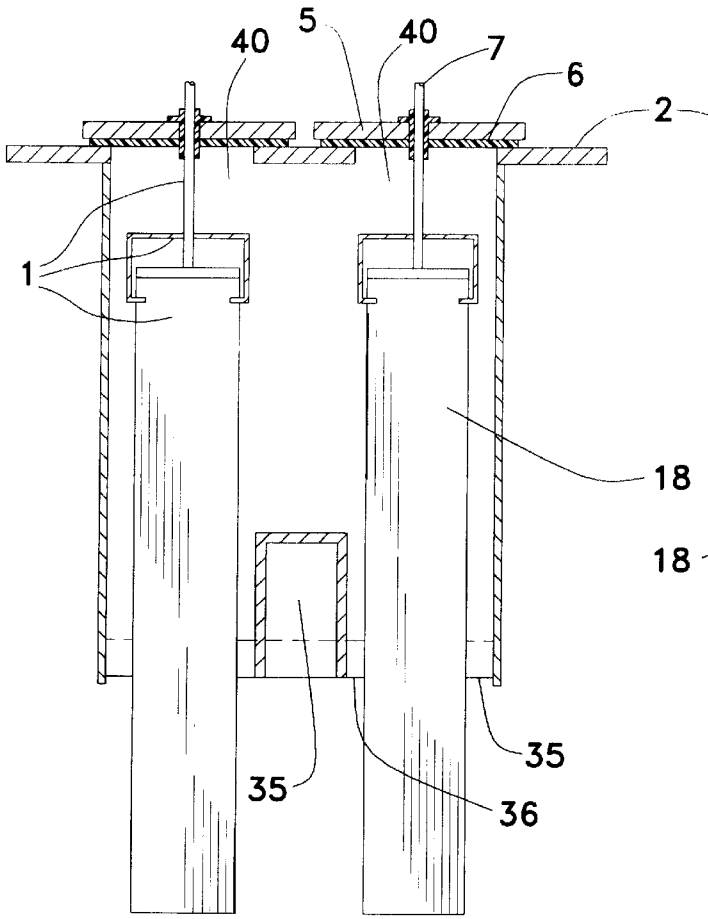
Figure 8C:
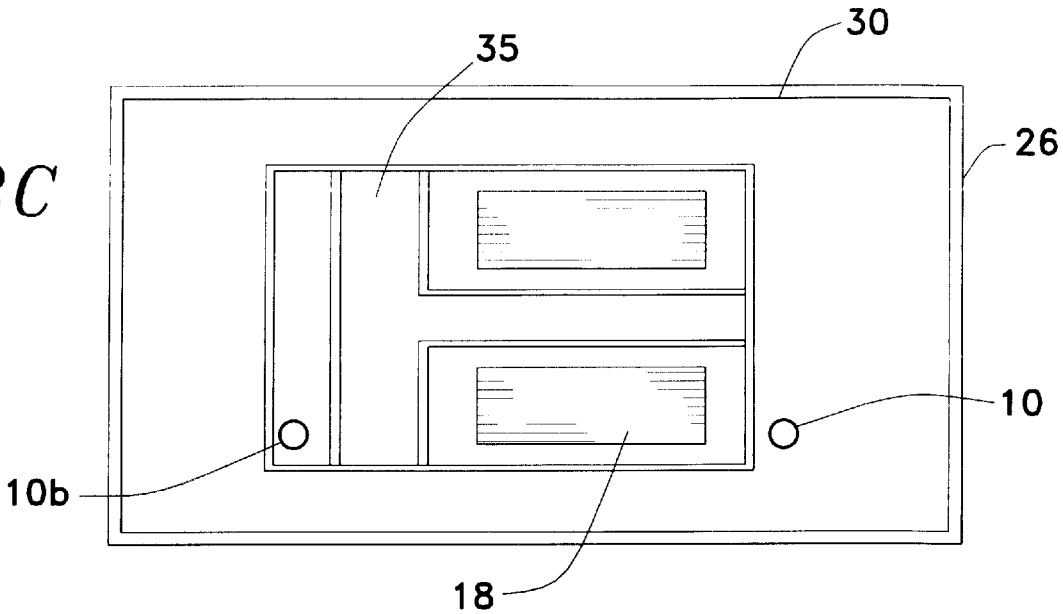
Figure 8D:
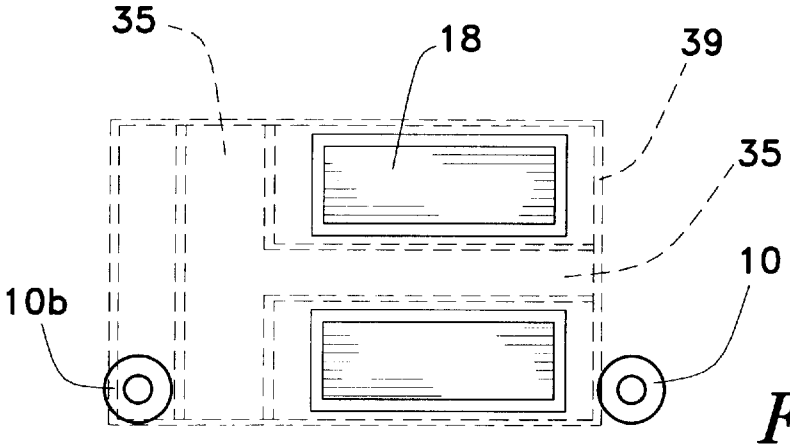

FIGS. 5 and 6 depict the cathode assembly for fluorine cells with one or two columns of anodes, showing how the cathode boxes 4 are supported and positioned in the cell in the grid arrangement.

In the prior art, the cathodes are supplied power by way of posts that pass through the head plate or through the cell case. The prior art only utilizes two parallel anode surfaces for interactive current flow. By contrast, the present invention uses all four sides of the anode 18 for interactive current flow with the cathode box 4. The cathode means in the instant invention teaches arrangement of the cathode in a grid box assembly having smooth flat surfaces running vertically parallel with each face of each anode. The cathode boxes 4 provide the interactive surfaces of the cathode that are a rectangular shaped device with four vertical walls with the cathode box grid open at the top and bottom. Each wall will be equal distance from the interacting vertical surfaces of the anodes. Of course differing numbers of anode faces and surfaces may be used, with the preferred embodiment optimizing ease of construction. Any failure to utilize all anode surface area results in necessitating higher current densities for a given production resulting in reduced efficiency and anode life.

For a fluorine cell with only one anode, only one side of each of the four cathode plate walls will be involved in the cathodic electrochemical reaction. For cells that have a single column of anodes 18 (3 or more), the cathode plates form a grid of boxes with each serving one anode, and one cathode plate wall may also serve the adjacent anode. Therefore, one or two walls of each box may serve two anodes 18. For cells with two parallel columns of anodes, the cathode box around one anode could have as many as 3 walls of the 4, also serving the adjacent anodes. The cathode boxes are suspended inside the fluorine cell case 5*a,* so the anodes 18 will not extend lower than the bottom edge of the cathode boxes 4. The top edge of the cathode boxes 4 are positioned so the distance to the anode 18 is closer than the distance from the skirt 30 to the cathode 4. The cathode boxes 4, (or in the case of a single cathode box), are supported and attached to a cathode support plate 26, which runs vertically from the cathode boxes 4 to the cathode support flange 3, at both ends of the columns of the grid boxes.

The cathode support plates 26 carry the cathode side D.C. current from the power supply connection lug-flange 29 to the cathode grid 4. Grid end plates are off set from the cathode support plates 26. The top end of the support plate 26 is welded to the inside edge of the cathode support flange 3, and nests inside the cell case wall 5, extending to near the bottom of the case. The bottom edge of each support plate 26 serves as a foot to secure the fluorocarbon "power isolation" sheet 17 to the case floor.

Power supplied to the cathode and anode is controlled through well known techniques in the art such as controlled rectifier circuits, potentiometer, variable current supplies, variable power supplies, the details of which are not necessary to the understanding and practice of the instant invention.

The cathode box 4 is welded to the cathode support plate 26 with the bottom edge several inches above the case floor 5*c* allowing unrestricted electrolyte melt circulation under the grid, and allowing melt to flow up through the interactive space between the cathode box 4 surfaces and the anodes 18. The cathode support plate 26, which is welded to the cathode support flange 3, is inset away from the cell case wall 5 and is electrically isolated from it at the cathode support flange 3. This inset location is positioned so that the distance from the cathode support plate 26 to any vertical skirt wall plate 30 is greater that the distance between the cathode boxes 4 to the anode's 18 interactive surface spacing.

FIGS. 7 and 8 illustrate the cell head plate 2 with its skirt 30 configuration for the single anode column and the two anode column cells. The cell head plate 2 itself is very similar to those of prior art, in that all piping to the inside, including electrolyte addition and the hydrogen vent lines 10 and the fluorine vent lines 10*b,* of the cell passes through this head plate, and the gas chamber dividing skirt is welded to the underside of the flat head plate, so it hangs down, inside the cell case. A three-flange plate connection at the top of the cell case. The top flange is the head plate flange 2*b* with a cathode support flange 3 above the cell case flange 5*b* as shown in FIG. 1. This allows the skirt 30 to nest inside the cathode support plates 26, which nests inside the cell case 5*a*.

The cell head plate 2 has an anode hole 40 or slot cut into it for each drop-in anode assembly 1 of the cell. The cathode assembly surrounds the anode hole 40 which is cut so the anode 18 and the anode hanger 50 can fit through the anode hole 40, and the anode hanger 50 above the top of the anode mounting plate 6 is bolted in a fixed position on top of the cell head plate 2. The surface of the cell head plate 2 around the anode hole 43 is machine finished flat with threaded studs for gasket sealing and securing the anode mounting plate 6 in position. Each anode hole 40 is positioned so that, when the anode 18 is in place, the bottom of the skirt 30 has a hydrogen channel 35 and lip 36 around all four sides of the anode 18, and all are an equal distance from that surface of the anode 18.

The skirt 30 is welded to the under side of the cell head plate 2. The outside vertical walls of the skirt form two chambers of gas space separation between the cell head plate 2 and the electrolyte melt, inside the cell. The cell could have from one to 48 anodes and may still have only two gas chambers for common collection of gases. The length of the skirt 30 down from the head plate 2 is sufficient to allow the anode hanger 50 to remain above the electrolyte melt level 14, except on occasions of abnormal pressure swings causing the melt level to surge up into the fluorine gas chamber 15. The hydrogen gas chamber 16 is outside the centrally located skirt 30 and the fluorine gas chamber 15 is inside the skirt box. The hydrogen chamber 16 encircles the fluorine chamber 15 and the outer wall of the hydrogen gas chamber is the cell case wall 5 itself. The fluorine gas chamber 15 is walled inside the skirt 30, and only the walls of the skirt 30 rise to the cell head plate 2. At no location is this skirt 30 closer to the cell case wall 5 or cathode support flange 3 than the interactive spacing between the anodes 18 and cathodes 4.

The skirt 30 has an arrangement of hydrogen channels 35 that collect evolved hydrogen gas from over the cathode box 4. The skirt, above the cathode means, has a series of hydrogen channels 35 angled upward and outward toward the hydrogen gas chamber 16 so that an upward rise in evolved hydrogen can push the electrolyte toward the cell case wall 5. These hydrogen channels provide a skirt separation lip 36 for each side of each anode 18. The hydrogen gas collection channels 35, normally completely submerged below the electrolyte melt surface 14, direct the hydrogen gas toward the cell case wall. The hydrogen gas, on its upward and outward ascent, pushes the electrolyte melt, which moves with the gas, toward the cell case wall 5 to the melt surface 14 in the hydrogen gas chamber 16. The hydrogen channels 35 are a component of the skirt 30, are parallel to one another, have a wall perpendicular to the skirt surface, and can vary in the depth of the channel walls, and have a common bottom depth, and most have a sloped ceiling in the hydrogen channel 35 to expedite the hydrogen gas movement out of the channel and into the hydrogen chamber 16.

In the fluorine gas chamber 15 the skirt is offset to one side in the cell, so there will be more cavity space in the hydrogen chamber 16 on the side of the cell where the evolved hydrogen gas is directed, and more space in the fluorine chamber on the side of the chamber away from the anode. The skirt 30 on the anode side of the cell has tapered hydrogen channel 35 walls at the lower portion of the cell's fluorine chamber 15 creating sloped hydrogen channels 35 which run from the cell's lower center toward the upper portion of the cell case wall 5. The skirt 30 also creates an unrestricted melt flow 27 circulation path from the hydrogen channels 35 to the cell case wall 5 and back down and under the cathode box 4.

The anode or columns of anodes are positioned to one side of the fluorine gas chamber 15, so all the evolved fluorine gas and hot circulating electrolyte melt will move to the more open cavity space of the fluorine gas chamber 15. The skirt wall of the fluorine gas chamber is offset away from the anodes 18 on one side so no rising gas movement occurs on that one particular side of the fluorine chamber. When more than one anode is used, the walls of the hydrogen channels on the skirt between anodes are sloped upward and outward from 1 inch high at the bottom to 4 inches high at the top of the hydrogen channels. The open space below the fluorine gas chamber 15 allows unrestricted melt circulation flow back down the wall of the cell (on the opposite side of the cell as the hydrogen chambers down flow), and under the cathode box grid 4.

The skirt wall 30 nearest the larger hydrogen gas cavity will have an ostensibly inverted v-shaped notch 34 of about ⅛ inch height to provide a specific location for cross recombination from any pressure differential to occurring there. This facilitates a bleeding of the gas from the high pressure/low electrolyte chamber to the low pressure/high electrolyte side. Hydrogen and fluorine recombine spontaneously increasing the pressure thereby equalizing the pressure between the two sides and balancing the level of the melt surface 14 in each chamber. The ostensibly inverted v-shaped notch 34 should be located to a place of minimal damage in the cell, normally on the skirt wall located closest to the hydrogen vent line 10. Cells with view ports 13 in this cavity will permit personnel to monitor this occurrence.

Figure 9:
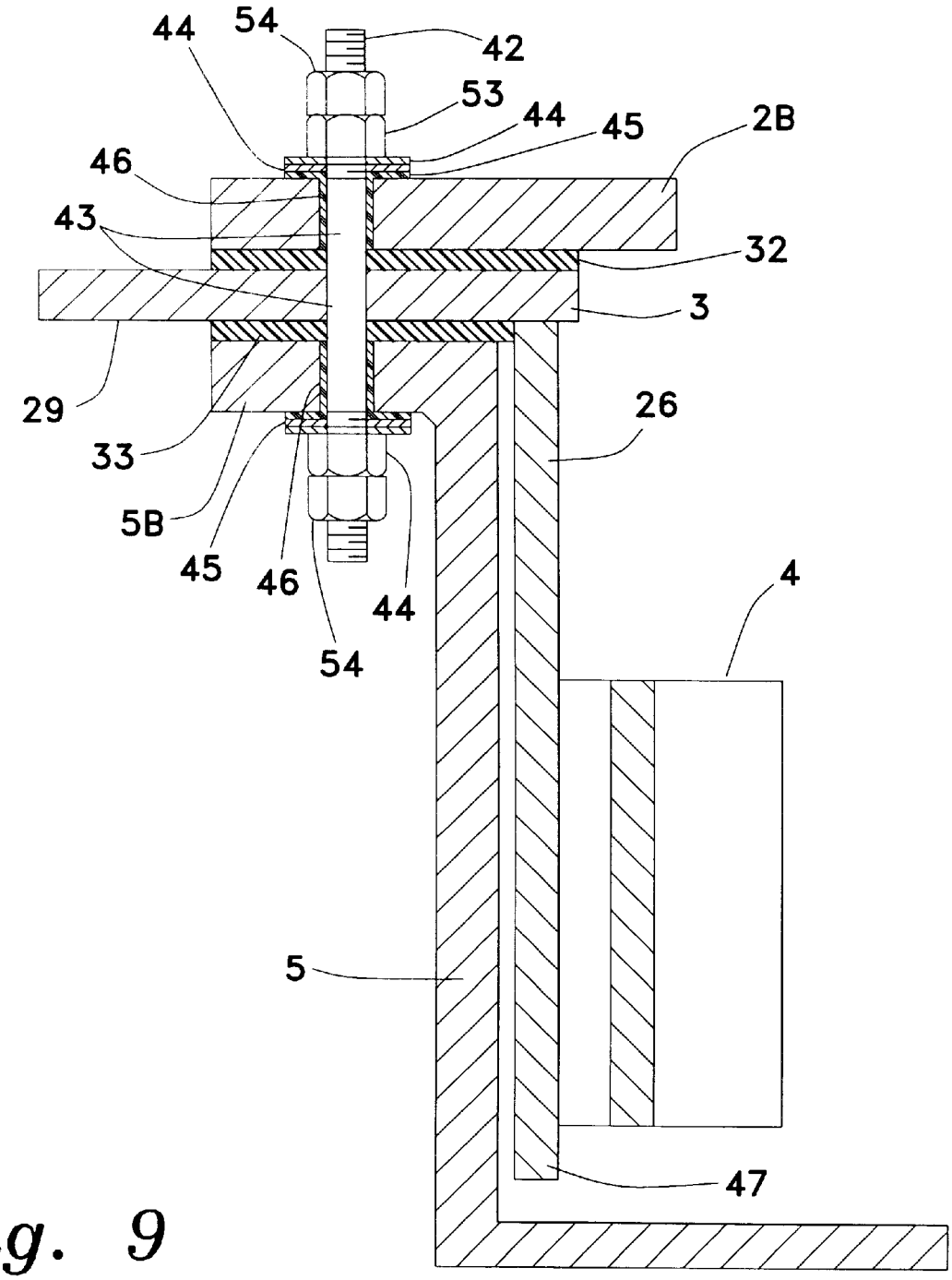
FIG. 9 diagrammatically shows a side sectional view of the cathode support flange configuration and bolting assembly.
Figure 10:
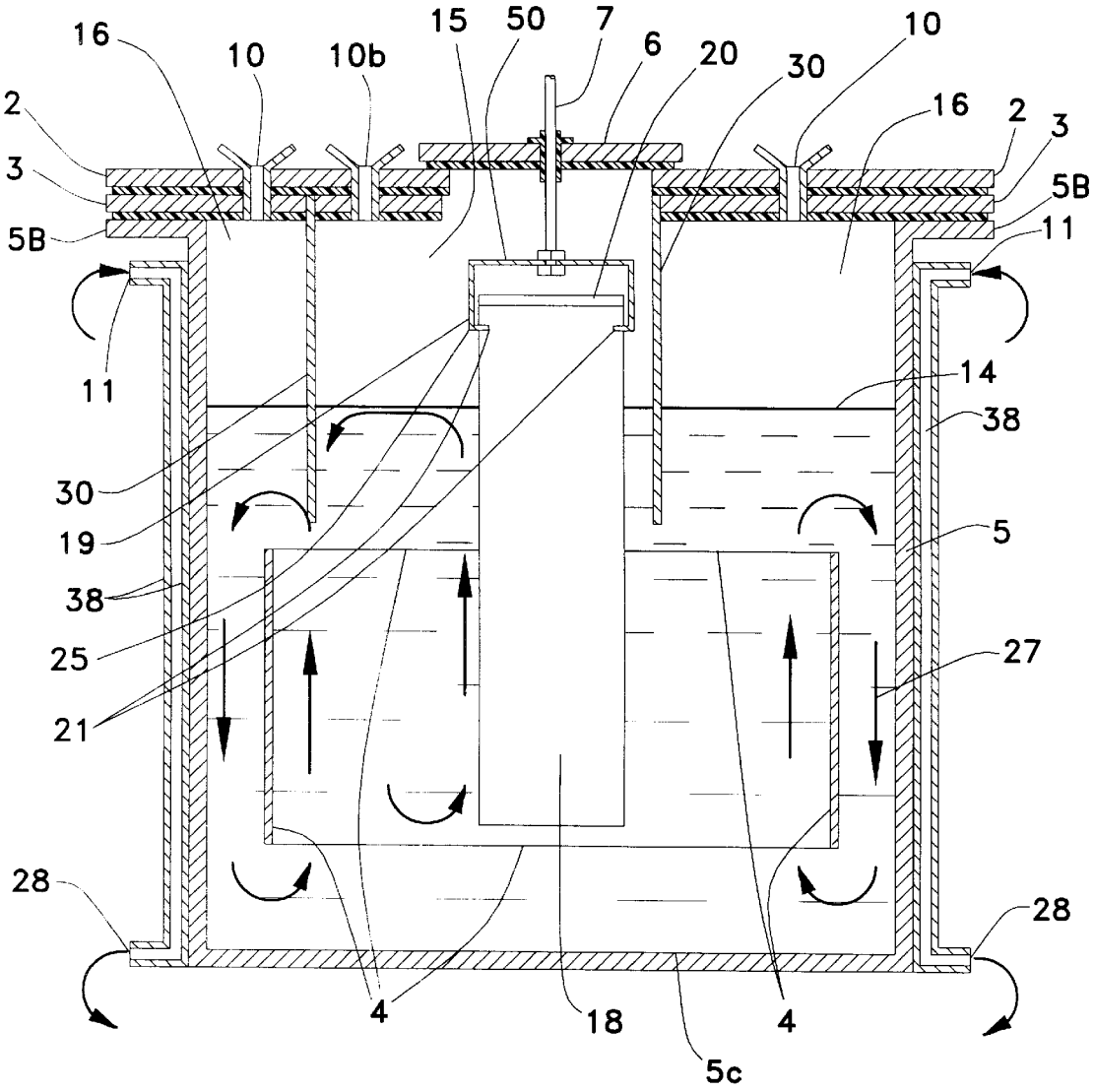
FIG. 10 diagrammatically shows a side sectional view of the cell showing the melt flow circulation.
Figure 11:
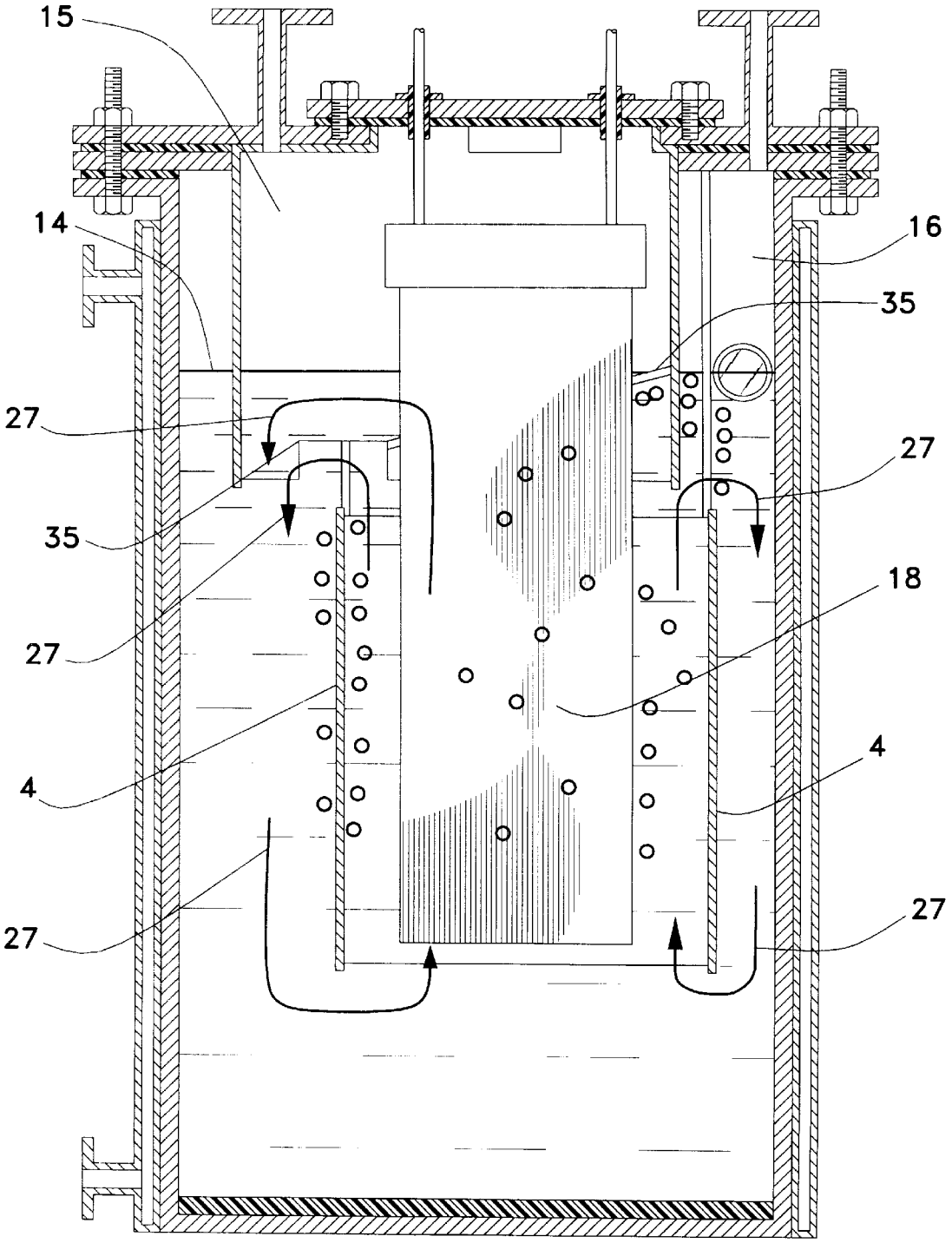
FIG. 11 shows a diagrammatic front section view of a single anode column cell and the melt flow circulation in the fluorine and hydgrogen gas chambers.

In FIG. 9 the new cell invention incorporates a three-piece flange assembly: the cell head plate flange 2*b,* the cathode support flange 3, and the cell case flange 5*b.* The cell head plate flange 2*b* on the underside of the cell head plate 2. The cathode power connection is made by bolting to the power supply 48 to the lug point 29 which on one end of the cathode support flange 3. The power supply connection lug point 29 is located between the cell case flange 5*b* (resting on top of this flange while in service), and the cell head plate flange 2*b* of the cell head plate 2. The gaskets 32 and 33 between both flanges, not only serve as a chemical seal barrier, but also an electrical isolation barrier. The inner edge of the cathode support flange 3 is inset approximately ¼ inch from the inner surface of the cell case wall 5.

The two cathode support plates 26 are welded vertically to the inside surface of the cathode support flange 3 and the two inter-flange surfaces are at opposite ends of the cell. The cathode support plate 26 carries the current from the lug point 29 to the cathode box 4. The securing bolts around the flange assembly are threaded through the cathode support flange's 3 lug point 29 where there are threaded bolt holes. The cathode support plate 26 and the cathode support flange 3 are electrically isolated from the cell case 5*a*.

The flange securing bolting assembly 41 uses a bolt mechanism for securing the cell case 5*a* to the cathode support flange 3 and to the cell head plate 2 using an all-thread rod 42. The flange holes 43 in the cell head plate 2 and the cell case flange 5 are oversized to allow a current isolating sleeve 46 to be slipped between the all-thread 42 and the hole wall. A current isolating washer 45 is placed on the all-thread rod following the sleeve 46. The isolating washer 45 is followed with a steel flat washer 44, and a torque pressure loading nut 53 backed up with a lock nut 54. The purpose of this bolting arrangement is to permit the cell head plate 2 along with the anode assembly 1 to be lifted out and away from the cell without disturbing the position of the cathode box 4. This also permits the cell head plate 2 and the cathode box 4 to be lifted out of the cell case as a single unit, (without disturbing the assembly anode to skirt to cathode spacing) for inspections and maintenance.

There is also an electrical isolation barrier 17 (such as a fluorocarbon power isolation sheet of plastic material like PTFE) so as to prevent electrolytic interaction from the bottom of the cell up to the anode blades, which would produce both hydrogen and fluorine gases in the same location.

The current carrying thread rod 7 of the anode must carry a uniform torque so as to prevent differing thermal expansion torque which could result in a breaking of the metal channel pieces 25. The grooved channel 21 ought be no more than ¼ inch because deeper groves weaken the anode blades risking breakage.

Other forms of the apparatus, and of electrochemical cells for performing the process of the invention, may be used, and appropriate heating means and cooling means may be incorporated in the systems of the invention.

The specific gas chambers and skirt 30 nest into and above the cathode box 4 and flange assemblies about a vertical axis. The skirt 30 encircles each anode 18 about the vertical axis of the anode 18. The skirt 30 extends below the melt surface 14 and the cell head plate 2. The skirt forms a portion of the separation barrier in directing the hydrogen cathodic gas to its respective chamber and the anodic fluorine gas to its respective chamber. The cell head flange 2*b* bolts to the cathode flange. When bolted together, the skirting assembly is aligned parallel with the cathode grid, as also are the anode blades with the cathode box 4, since they are both alignment mounted in the cell head plate 2. The skirt 30 is normally fabricated using Monel plate, which is welded to the underside of the cell head plate 2. However, a functional gas separation skirting arrangement of other materials and designs and construction may be used within the cell without departing from the spirit and intent of the disclosed invention.

Each anode has two current carrying posts in the form of thread rods (7,7) that are mounted through an electrically isolating packing seal junction port in its anode cover plate, which is individually mounted and electrically isolated from the cell head plate 2. These two isolation seals also isolate the fluorine gas chamber 15 from the outside atmosphere.

There are three electrical isolation seals across the cell between the anode and cathode current paths, and four (4) seals from the anode to the cell case. This greatly reduces the potential for electrical short circuiting from outside conditions.

The skirting arrangement provides the cell with a single open chamber outlet for the evolving fluorine gas, with enough retention time for reducing misting while allowing easy, quick purging. A cavity is positioned to one side of the column of anodes to provide a melt circulation path, also reducing misting, and improving heat dispersal.

The anode connection should:

a) always be above the melt surface to prevent the metal from corrosion;

b) have a very high metal to carbon surface area contact with a smooth and tight face to face contact, so liquid cannot get between them, and so the electrical current density per square inch of contact surface is low. This prevents the current flow through this junction from generating a hot spot for fluorine reaction; and c) permit no metal to carbon deep penetration, where melt can creep between them and then swell and crack the carbon.

The hydrogen channels 35 of skirt 30 direct the evolved hydrogen gas away from the cathode grid in sloping channels located under the surface of the electrolyte melt surface 14 and between the anodes 18, and discharging hydrogen into the hydrogen chamber 16 on the opposite side of the anodes 18 from the fluorine chamber 15. The gas movement also a) reduces misting, b) promotes melt circulation, and c) improves melt heat dispersal.

The promoted melt circulation helps:

a) sweep the clinging bubbles up the interactive surfaces and assists in reducing the potential for both anode and cathode polarization;

b) results in a more uniform melt temperature with a lower differential temperature across the cell, wherein the lower mean temperature will reduce hydrogen fluoride boil off and losses;

c) the promoted melt circulation will produce a more uniform blending of the hydrogen feed into the cell, improving cell production, and reducing corrosion; and d) the more uniform melt surface area of a near one to one ratio between gas chambers reduces the potential for melt level 14 swings with differential pressures, and the large void space for each gas chamber will help prevent pressure blow through spillage of melt in the gas discharge headers.

The hydrogen channels 35 of skirt 30 with its level bottom edges form an arrangement of channels that collect the evolved hydrogen gas from over the cathode box 4. These channels provide a skirt separation lip for each side of each anode 1. These hydrogen channels 35 and lips 36 are normally completely submerged below the electrolyte melt level 14 and collect the gas and directs and pushes the melt flow 27 that moves with it to the melt surface 14 in the hydrogen gas chamber 16. All of these channels have a common bottom lip depth, and most have a slopped ceiling in the hydrogen channel 35 to expedite the hydrogen gas movement out of the hydrogen channel and into the hydrogen chamber 16.

The fluorine gas chamber 15 skirt is offset to one side in the cell case 5*a,* so there will be more cavity space in the hydrogen chamber 16 on the side, where the evolved hydrogen gas is directed. This also creates an unrestricted melt circulation flow path from the hydrogen channels 35 to the cell wall 5 and back down and under the cathode box 4 grid.

It is to be understood that the present invention is not limited to the embodiments described above, but encompasses any and all embodiments within the scope of the following claims.

I claim:

1. A system for the electrolysis of fluorine gas comprising:

an electrolytic cell comprising a reservoir of electrolytes containing a hydrogen-fluoride solution and having a melt surface;

a cell case having a sidewall, an upper portion, a lower portion and a cell case flange;

a cell head plate having an underside surface and attached to said cell case at said upper portion, cell head plate flange on said lower portion;

a cell floor attached to said cell case at said lower portion;

at least one independently mounted anode having flat surfaces and aligned in a vertical direction from the upper portion of said case to the lower portion of said cell case, whereby said anode is electrically isolated from the cell head plate and capable of being interchangeably dropped into said electrolytic cell;

at least one anode mounting plate bolted to said cell head plate, wherein said anode mounting plate is attached to an anode support hanger and said anode support hanger corresponds to and is attached to said independently mounted anode;

said anode support hanger is positioned in parallel alignment with the cathode means and positioned above the melt surface of the electrolytes;

a cathode box having cathode grid plates arranged in a grid pattern located inside said cell case about a vertical axis and positioned parallel to said anode and mounted to a cathode support flange via a cathode support assembly, wherein said cathode support flange is mounted to said cell case flange;

said cathode box is electrically isolated from the cell case and the cell head plate flange and located radially inside said cell;

said reservoir of electrolytes comes in contact with the anode and the cathode;

a gas separation skirting arrangement located on the underside surface of said cell head plate with the cell head plate nested radially about a vertical axis between the cathode and the anode, said gas separation skirting arrangement forming at least two isolation chambers comprising a fluorine gas chamber and a hydrogen gas chamber, wherein said isolation chambers provide a barrier for separating fluorine gas evolved from said anode in said fluorine gas chamber and hydrogen gas evolved from said cathode in said hydrogen gas chamber;

said hydrogen gas chamber, which is completely separated from said fluorine gas chamber, substantially surrounds said fluorine gas chamber;

said gas separation skirting arrangement has a bottom edge which is level and positioned above and at an equal distance from said cathode box at all points but one, wherein that one point is an edge high point forming a notch in the gas separation skirting arrangement, said edge high point extending below the melt surface and permitting a recombination of gases from a higher pressure chamber to a lower pressure chamber via said notch;

wherein said gas separation skirting arrangement extends below the melt level of said electrolytes in the cell directing an electrolyte flow within the electrolytes above the cathode box and against the sidewall of the cell case, said gas separation skirt arrangement is positioned to enable the electrolytes to be pushed upward towards the cell head plate by gases evolved at the cathode box and in a downward flow path to circulate past the cathode box on the side opposite of each anode, the gas separation skirting arrangement is positioned to deflect a flow path for the electrolytes circulating radially outward past the top of the cathode box, down the cell wall on the opposite of the cathode box from each anode, and inward below the cathode box, thereby inducing an electrolyte circulation flow path into both the fluorine gas chamber and the hydrogen gas chamber;

said gas separation skirting arrangement is positioned to deflect a flow path for the electrolyte circulating radially outward past the top of the cathode box, down the cell wall on the opposite of the cathode box from each anode, and inward below the cathode box;

said gas separation skirting arrangement further comprises a series of hydrogen channels located above said cathode means and sloped upward and outward toward the hydrogen gas chamber so that an upward rise in evolved hydrogen gas can push the electrolytes toward the sidewall of the cell; and a power connection lug located on the cathode support flange connects said cathode box to a power supply.

2. A system according to claim 1, wherein the electrolytic cell further comprises:

a cell case wall cooling jacket containing a cooling media and located proximate the cell case in order to complete a circulatory electrolyte flow loop within the electrolyte by increasing electrolyte density such that the electrolyte drops along the sidewall to the cell floor thereby completing a circulation loop of the electrolytes;

said cathode box is positioned closer to the anode than the gas separation skirting arrangement;

a hydrogen vent line opening into the hydrogen gas chamber; and wherein said notch is positioned distant the anode on the fluorine gas chamber and proximate the hydrogen vent line on the hydrogen gas chamber.

3. A system according to claim 1 wherein:

said cell floor is covered by an electrical isolation barrier;

said anode comprises a carbon blade;

said anode is mechanically secured to the anode support hanger with two current carrying posts that apply a uniform torque loading to a contact pressure plate on the anode support hanger and said anode held in place by a tongue that does not penetrate the anode more than a ¼ inch depth;

said anode has grooved channels and said tongue and the grooved channels where the contact is made are polished to a near mirror finish maximizing tight contact to reduce potential for electrical heating at a junction;

said mounting plate is removable for inspection of anodes; and a point of connection to the anode and said anode support hanger is positioned above a melt surface of the electrolytes.

4. An apparatus for the electrolytic production of gas through electrolysis comprising:

an electrolytic cell;

said cell capable of holding electrolytes located within the electrolytic cell;

a cell case having a sidewall, an upper portion, a lower portion and a cell case flange;

a cell head plate having an underside surface and said cell head plated located above the said cell case at said upper portion;

a cell floor attached to said cell case at said lower portion;

at least one independently mounted anode having flat surfaces and aligned in a vertical direction from the upper portion of said case to the lower portion of said cell case;

at least one anode mounting plate attached to said cell head plate, wherein said anode mounting plate is attached to an anode support hanger and said anode support hanger corresponds to and is attached to said independently mounted anode;

a cathode means located inside said cell case about a vertical axis and positioned parallel to said anode and mounted to a cathode support flange via a cathode support assembly, wherein said cathode support flange is mounted to said cell case flange;

said cathode means comprises a cathode box having cathode grid plates arranged in a grid pattern, said cathode box is electrically isolated from the cell case and the cell head plate flange, and located radially inside said cell;

said anode support hanger is positioned in parallel alignment with the cathode means and positioned above the melt surface of the electrolytes;

a gas separation skirting arrangement located on the underside surface of said cell head plate and nesting radially about a vertical axis between the cathode means and the anode forming at least two isolation chambers comprising a first gas chamber and a second gas chamber;

wherein said isolation chambers provide a barrier for separating gas evolved from said anode in said first gas chamber and gas evolved from said anode means in said second gas chamber; and wherein said gas separation skirting arrangement is positioned to deflect a flow path for electrolytes circulating radially outward past the top of the cathode means, down the cell wall on the opposite of the cathode means from each anode, and inward below the cathode means.

5. An apparatus according to claim 4, further comprising:

a cell case wall cooling jacket containing a cooling media and located proximate the cell case in order to complete a circulatory electrolyte flow loop within the electrolyte by increasing electrolyte density such that the electrolyte drops along the sidewall to the cell floor thereby completing the circulation; and a power connection lug located on the cathode support flange connects said cathode means to a power supply;

said anode mounting plate is removable for inspection of anodes.

6. An apparatus according to claim 4, wherein:

a reservoir comprising a hydrogen-fluoride solution having a melt surface, wherein said reservoir of electrolytes contacts the anode and the cathode means;

said anode is electrically isolated from the cell head plate; and said gas separation skirting arrangement is nested radially, about a vertical axis inside the cathode support assembly, said cell head plate abutting with and bolted to the cathode support flange.

7. An apparatus according to claim 6, wherein:

said cell floor is covered by an electrical isolation barrier;

said gas separation skirting arrangement forms exactly two isolation chambers;

said first gas chamber contains hydrogen gas and said second gas chamber contains fluoride gas; and wherein said gas separation skirting arrangement extends below the melt surface of said electrolytes in the cell directing an electrolyte flow within the electrolytes above the cathode means and against the sidewall of the cell case, the gas separation skirting arrangement is positioned to deflect a flow path for the electrolytes circulating radially outward past the top of the cathode means, said gas separation skirt arrangement is positioned to enable the electrolytes to be pushed upward towards the cell head plate by gases evolved at the cathode means and in a downward flow path to circulate past the cathode means on the side opposite of each anode, down the cell wall on the opposite of the cathode means from each anode, and inward below the cathode means, thereby inducing an electrolyte circulation flow path into both the fluorine gas chamber and the hydrogen gas chamber.

8. An apparatus according to claim 6 further comprising a cell case wall cooling jacket containing a cooling media and located proximate the cell case in order to complete a circulatory electrolyte flow loop within the electrolyte by increasing electrolyte density such that the electrolyte drops along the sidewall to the cell floor completing thereby completing the circulation, wherein said cooling means enters said jacket at a top portion of the cooling jacket and exits at a bottom portion of the cooling jacket.

9. An apparatus according to claim 6 wherein:

said hydrogen gas chamber, which is completely separated from said fluorine gas chamber, substantially surrounds said fluorine gas chamber; and said gas separation skirting arrangement has a bottom tapered edge which is level and positioned above and at an equal distance from said cathode means at all points but one, wherein that one point is an edge high point forming a notch in the gas separation skirting arrangement, said edge high point extending above the melt surface and permitting a recombination of gases from a higher pressure chamber to a lower pressure chamber via said notch.

10. An apparatus according to claim 9 wherein:

said gas separation skirting arrangement forms exactly two isolation chambers;

said notch is positioned distant the anode on the fluorine gas chamber and proximate the hydrogen evacuation lines on the hydrogen gas chamber.

11. An apparatus according to claim 6 wherein:

said gas separation skirting arrangement further comprises a series of hydrogen channels located above said cathode means and sloped upward and outward toward the hydrogen gas chamber so that an upward rise in evolved hydrogen gas can push the electrolytes toward the sidewall of the cell.

12. An apparatus according to claim 4, wherein said cathode means has at least four flat surfaces.

13. An apparatus according to claim 4 wherein:

said anode is mechanically secured to the anode support hanger with two current carrying posts that apply a uniform torque loading to a contact pressure plate on the anode support hanger and said anode held in place by a tongue that does not penetrate the anode more than a ¼ inch depth;

said anode has grooved channels and said tongue and the grooved channels where the contact is made are polished to a near mirror finish maximizing tight contact to reduce potential for electrical heating at a junction; and a point of connection to the anode and said anode support hanger is positioned above a melt surface of the electrolytes.

14. An apparatus according to claim 4 wherein:

said cathode means is positioned closer to the anode than the gas separation skirting arrangement.

15. An apparatus for the production of gas through electrolysis comprising:

a cell holding an electrolyte solution having a melt surface;

a cell head plate;

at least one anode having two ends, said anode having grooved channels in at least one end and having at least four flat faces;

said grooved channels located above the melt surface of the electrolyte;

at least one cathode means having a plurality of flat faces, wherein said cathode means located radially about the vertical axis around said anode, wherein each flat face of said cathode means corresponds with and is parallel to each of said four flat faces of said anode;

said cathode means comprises a cathode box having cathode grid plates arranged in a grid pattern, said cathode box is electrically isolated from the cell case and the cell head plate flange, and located radially inside said cell;

at least one anode mounting plate attached to said cell head plate, wherein said anode mounting plate is electrically isolated from said cell head plate;

at least one set of electrically conductive metal channel pieces having tongues that protrude inward toward one another, said metal channel pieces attached to said anode mounting plate by way of an anode hanger;

wherein said anode is attached is said electrically conductive metal channel pieces such that said tongues are securely pressed into the grooved channels of said anode and having a sufficiently tight and congruent fit to the grooved channel as to make contact on substantially all surfaces of the grooved channels;

a separation means for separating gasses evolved at the cathode from the gasses evolved at each anode; and a collection means for separately collecting the gasses evolved above the anode and the cathode means.

16. The apparatus according to claim 15 wherein:

said anode mounting plate is removable for inspection of said anodes.

* * * * *